US007514870B2

(12) United States Patent
Lee et al.

(10) Patent No.: US 7,514,870 B2
(45) Date of Patent: Apr. 7, 2009

(54) PLASMA DISPLAY PANEL HAVING FIRST AND SECOND ELECTRODE GROUPS

(75) Inventors: Eun-Cheol Lee, Kumi-shi (KR); Jae-Sung Kim, Kumi-shi (KR); Young-Joon Ahn, Kumi-shi (KR); Seok Dong Kang, Kumi-shi (KR); Young-Kyo Shin, Seoul (KR); Sung-Yong Ahn, Kumi-shi (KR); Song-Won Chi, Kyungsangbuk-do (KR); Jae-Hong Lee, Taegu-shi (KR); Tae-Wan Choi, Kumi-shi (KR); Jeong-Pil Choi, Suwon-shi (KR); Tae-Hyung Kim, Seoul (KR); Geun-Soo Lim, Sungnam-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/581,076

(22) Filed: Oct. 16, 2006

(65) Prior Publication Data

US 2007/0108903 A1 May 17, 2007

Related U.S. Application Data

(63) Continuation of application No. 09/897,404, filed on Jul. 3, 2001, now Pat. No. 7,133,005.

(30) Foreign Application Priority Data

| | | |
|---|---|---|
| Jul. 5, 2000 | (KR) | 10-2000-38274 |
| Jul. 24, 2000 | (KR) | 10-2000-42445 |
| Nov. 24, 2000 | (KR) | 10-2000-70259 |
| Nov. 24, 2000 | (KR) | 10-2000-70260 |
| Dec. 30, 2000 | (KR) | 10-2000-87060 |
| Jan. 18, 2001 | (KR) | 10-2001-03007 |

(51) Int. Cl.
*H01J 17/49* (2006.01)

(52) U.S. Cl. ..... 313/582; 313/583; 313/585; 313/586; 313/587

(58) Field of Classification Search ..... 313/582–587
See application file for complete search history.

(56) References Cited

U.S. PATENT DOCUMENTS 5,682,217 A 10/1997 Hisatake et al. ..... 349/123

(Continued)

FOREIGN PATENT DOCUMENTS

EP 1 041 599 A3 11/2000

(Continued)

OTHER PUBLICATIONS 2 pages of Search Report from European Patent Office dated Jan. 26, 2007.

*Primary Examiner*—Joseph L Williams
*Assistant Examiner*—Kevin Quarterman
(74) *Attorney, Agent, or Firm*—KED & Associates, LLP

(57) ABSTRACT

A plasma display panel and a method and apparatus for driving the same are provided that are capable of preventing miss-writing and improving discharge and light-emission efficiencies. In the panel, an upper substrate and a lower substrate are opposed to each other and have a plurality of discharge cells therebetween. A first upper electrode group is formed on the upper substrate and includes at least one electrode. A second upper electrode group is formed on the upper substrate in such a manner to be adjacent to the first upper electrode group and includes at least one electrode having a different width from the first upper electrode group. A data electrode is provided on the lower substrate in such a manner to be perpendicular to the first and second upper electrode groups.

41 Claims, 27 Drawing Sheets

U.S. PATENT DOCUMENTS

| | | | | |
|---|---|---|---|---|
| 6,031,329 | A | 2/2000 | Nagano | 313/582 |
| 6,211,614 | B1 * | 4/2001 | Katayama et al. | 313/582 |
| 6,249,264 | B1 * | 6/2001 | Sano et al. | 345/60 |
| 6,504,519 | B1 | 1/2003 | Ryu et al. | 345/60 |
| 6,517,400 | B1 * | 2/2003 | Cho et al. | 445/24 |
| 6,522,072 | B1 | 2/2003 | Yura et al. | 313/582 |
| 6,531,819 | B1 * | 3/2003 | Nakahara et al. | 313/584 |
| 6,577,061 | B2 * | 6/2003 | Sano et al. | 313/582 |
| 6,650,051 | B1 * | 11/2003 | Park et al. | 313/582 |
| 2004/0001034 | A1 | 1/2004 | Marcotte | 345/60 |

FOREIGN PATENT DOCUMENTS

| | | |
|---|---|---|
| JP | 4-092340 | 3/1992 |
| JP | 5-121006 | 5/1993 |
| JP | 05-121006 | 5/1993 |
| JP | 5-266800 | 10/1993 |
| JP | 7-065729 | 3/1995 |
| JP | 08-227664 | 9/1996 |
| JP | 08-306318 | 11/1996 |
| JP | 10-149774 | 6/1998 |
| JP | 10-333636 | 12/1998 |
| JP | 2000-040473 | 2/2000 |
| JP | 2000-123750 | 4/2000 |
| JP | 2000 285814 | 10/2000 |
| JP | 2002-170493 | 6/2002 |
| KR | 1998-79982 | 11/1998 |
| KR | 2000-0013227 | 3/2000 |
| KR | 2000-035306 | 6/2000 |
| KR | 2000-56712 | 9/2000 |
| WO | WO 99/09579 | 2/1999 |
| WO | WO 01/56052 | 8/2001 |

* cited by examiner

PLASMA DISPLAY PANEL HAVING FIRST AND SECOND ELECTRODE GROUPS

CROSS-REFERENCE TO RELATED APPLICATIONS

This application is a Continuation Application of prior U.S. patent application Ser. No. 09/897,404 filed Jul. 3, 2001,(now U.S. Pat. No. 7,133,005), which claims priority under 35 U.S.C. §119 to Korean Application Nos. P2000-38274 filed on Jul. 5, 2000, in Korea; P2000-42445 filed on Jul. 24, 2000, in Korea; P2000-70259 filed on Nov. 24, 2000, in Korea; P2000-70260 filed on Nov. 24, 2000, in Korea; P2000-87060 filed on Dec. 30, 2000, in Korea; and P2001-03007 filed on Jan. 18, 2001, in Korea, whose entire disclosures are hereby incorporated by reference.

BACKGROUND OF THE INVENTION

1. Field of the Invention

This invention relates to a plasma display panel, and more particularly to a plasma display panel that is capable of preventing miss-writing and improving discharge and light-emission efficiencies. The present invention also is directed to a method and apparatus for driving the plasma display panel.

2. Description of the Related Art

Generally, a plasma display panel (PDP) radiates a fluorescent body by an ultraviolet with a wavelength of 147 nm generated during a discharge of He+Xe or Ne+Xe gas to thereby display a picture including characters and graphics. Such a PDP is easy to be made into a thin-film and large-dimension type. Moreover, the PDP provides a very improved picture quality owing to a recent technical development. Particularly, since a three-electrode, alternating current (AC) surface-discharge PDP lowers a voltage required for a discharge by utilizing wall charges accumulated in the surface thereof upon discharge and protects electrodes from a sputtering generated by the discharge, it has advantages of low-voltage driving and long life.

Referring to FIG. 1, a conventional three-electrode, AC surface-discharge PDP includes a scanning electrode Y and a sustaining electrode Z provided on an upper substrate 10, and a data electrode X provided on a lower substrate 18. The scanning electrode Y and the sustaining electrode Z have transparent electrodes 12Y and 12Z with a large width and metal bus electrodes 13Y and 13Z with a small width, respectively, and are formed on the upper substrate in parallel. Since the metal bus electrodes 13Y and 13Z reflects a light to deteriorate a contrast, light-shielding layers 15Y and 15Z are provided between the metal bus electrodes 13Y and 13Z and the upper substrate 10 as shown in FIG. 2. The light-shielding layers 15Y and 15Z absorb a light going into the metal bus electrodes 13Y and 13Z via the upper substrate 10.

An upper dielectric layer 14 and a protective film 16 are disposed on the upper substrate 10 in such a manner to cover the scanning electrode Y and the sustaining electrode Z. Wall charges generated upon plasma discharge are accumulated in the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO).

The data electrode X is perpendicular to the scanning electrode Y and the sustaining electrode Z.

A lower dielectric layer 22 and barrier ribs 24 are formed on the lower substrate 18. The surfaces of the lower dielectric layer 22 and the barrier ribs 24 are coated with a fluorescent material layer 26. The barrier ribs 24 separate adjacent discharge spaces in the horizontal direction to thereby prevent optical and electrical crosstalk between adjacent discharge cells. The fluorescent layer 26 is excited by an ultraviolet ray generated during the plasma discharge to generate any one of red, green and blue visible light rays. An inactive mixture gas of He+Xe or Ne+Xe is injected into a discharge space defined between the upper and lower substrate 10 and 18 and the barrier rib 24.

Such a three-electrode AC surface-discharge PDP drives one frame, which is divided into various sub-fields having a different discharge frequency, so as to realize gray levels of a picture. Each sub-field is again divided into a reset interval for uniformly causing a discharge, an address interval for selecting the discharge cell and a sustaining interval for realizing the gray levels depending on the discharge frequency.

For instance, when it is intended to display a picture of 256 gray levels, a frame interval equal to (1/60) second (i.e. 16.67 msec) is divided into 8 sub-fields SF1 to SF8. Each of the 8 sub-fields SF1 to SF8 is again divided into a reset interval, an address interval and a sustaining interval. The reset interval and the address interval of each sub-field are equal every sub-field. The address discharge for selecting the cell is caused by a voltage difference between the data electrode X and the scanning electrode Y. The sustaining interval is increased at a ratio of $2^n$ (wherein n=0, 1, 2, 3, 4, 5, 6 and 7) at each sub-field. A sustaining discharge frequency in the sustaining interval is controlled at each sub-field in this manner, to thereby realize a gray scale required for a picture display. The sustaining discharge is generated by a high voltage of pulse signal applied alternately to the scanning electrode Y and a sustaining electrode Z.

FIG. 3 illustrates driving waveforms of the three-electrode AC surface-discharge PDP.

Referring to FIG. 3, in the reset interval, a reset discharge for initializing the discharge cell is generated by a reset pulse Vr applied to the sustaining electrode Z. Such a reset pulse Vr may be applied to the scanning electrode Y.

In the address interval, a scanning pulse—Vsc is sequentially applied to the scanning electrode Y and a data pulse Vd synchronized with the scanning pulse—Vsc is applied to the data electrode X. An address discharge is generated at the discharge cell supplied with the data pulse Vd. A low-level positive direct current voltage is applied to the sustaining electrode Z so as to prevent an erroneous discharge from being generated between the data electrode X and the sustaining electrode Z.

In the sustaining interval, a sustaining pulse Vs are alternately applied to the scanning electrode Y and the sustaining electrode Z. Then, the discharge cells selected by the address discharge generates a sustaining discharge continuously whenever the sustaining pulse Vs is applied.

Since such a three-electrode, AC surface-discharge PDP has the scanning electrode Y and the sustaining electrode Z positioned at the upper center of the discharge space, it has a low utility of the discharge space. For this reason, in the three-electrode, AC surface-discharge PDP, a voltage for causing a sustaining discharge and a power consumption are high while discharge and light-emission efficiencies during the sustaining discharge are low. More specifically, the sustaining discharge takes a surface discharge between the scanning electrode Y and the sustaining electrode Z. However, since the scanning electrode Y and the sustaining electrode Z concentrate at the center of the cell to lower a discharge-initiating voltage, a discharge path becomes short to cause low discharge and light-emission efficiencies. When allowing a distance between the scanning electrode Y and the sustaining electrode Z to be enlarged so as to raise the efficiencies, a discharge-initiating voltage becomes high in proportion to a distance between the two electrodes. Furthermore, when allowing an electrode width of at least one of the scanning electrode Y and the sustaining electrode Z to be widened, power consumption rises due to an increase in discharge current.

In order to solve the problems of the three-electrode, AC surface-discharge PDP, there has been suggested a five-electrode PDP in which an electrode for causing a sustaining discharge is divided into four electrodes.

Referring to FIG. 4 and FIG. 5, the conventional five-electrode PDP includes first and second trigger electrodes TY and TZ provided on an upper substrate 30 in such a manner to be positioned at the center of a discharge cell, first and second sustaining electrodes SY and SZ provided on the upper substrate 30 in such a manner to be positioned at the edge of the discharge cell, and a data electrode X provided at a lower substrate 40 in such a manner to be perpendicular to the trigger electrodes TY and TZ and the sustaining electrodes SY and SZ.

The trigger electrodes TY and TZ and the sustaining electrodes SY and SZ include transparent electrodes having a large width and metal bus electrodes having a small width, respectively, and are formed on the upper substrate 10 in parallel. The trigger electrodes TY and TZ can be easily discharged at a low potential difference because a distance Ni between the electrodes is small. The first trigger electrode TY also plays a role to cause an address discharge by a voltage level difference between an applied scanning pulse and a data pulse applied to the data electrode X. The sustaining electrodes SY and SZ are set to have a large distance Wi between the electrodes with having the trigger electrodes TY and YZ therebetween. The sustaining electrodes SY and SZ causes a long-path discharge by utilizing space charges and wall charges formed by a discharge between the trigger electrodes TY and TZ.

An upper dielectric layer 36 and a protective film 38 are disposed on the upper substrate 30 in such a manner to cover the trigger electrodes TY and TZ and the sustaining electrodes SY and SZ. Wall charges generated upon plasma discharge are accumulated in the upper dielectric layer 36. The protective film 38 prevents a damage of the upper dielectric layer 36 caused by a sputtering during the plasma discharge and improves the emission efficiency of secondary electrons. This protective film 38 is usually made from magnesium oxide (MgO).

A lower dielectric layer 44 and barrier ribs 46 are formed on the lower substrate 40. The surfaces of the lower dielectric layer 44 and the barrier ribs 46 are coated with a fluorescent material layer 48. The barrier ribs 46 separate adjacent discharge spaces in the horizontal direction to thereby prevent optical and electrical crosstalk between adjacent discharge cells. The fluorescent material layer 48 is excited by an ultraviolet ray generated during the plasma discharge to generate any one of red, green and blue visible light rays. An inactive mixture gas of He+Xe or Ne+Xe is injected into a discharge space defined among the upper and lower substrate 30 and 40 and the barrier ribs 46.

Like the three-electrode PDP, such a five-electrode AC surface-discharge PDP drives one frame, which is divided into various sub-fields having a different discharge frequency, so as to realize gray levels of a picture. This will be described in detail in conjunction with FIG. 6 and FIG. 7.

FIG. 6 and FIG. 7 show a configuration of a trigger/sustaining driving apparatus for the five-electrode PDP and output waveforms thereof, respectively.

Referring to FIG. 6, the driving apparatus for the five-electrode PDP includes a first sustaining driver 58 for driving a first sustaining electrode SY, a first trigger driver 56 for driving the first trigger electrode TY, a second sustaining driver 62 for driving the second sustaining electrode SZ, and a second trigger driver 60 for driving the second trigger electrode TZ.

The first sustaining driver 58 applies a negative direct current (DC) voltage to the first sustaining electrode SY in the address interval and thereafter applies a sustaining pulse to the first sustaining electrode SY in the sustaining interval. The first trigger driver 56 applies a negative scanning pulse to the first trigger electrode TY in the address interval and thereafter applies a sustaining pulse to the first trigger electrode TY in the sustaining interval. The second sustaining driver 62 applies a positive DC voltage to the second sustaining electrode SZ in the sustaining interval and thereafter applies a sustaining pulse to the second sustaining electrode SZ in the sustaining interval. The second trigger driver 60 applies a reset pulse to the second trigger electrode TZ in the reset interval and thereafter applies a positive DC voltage to the second trigger electrode TZ in the address interval. Further, the second trigger driver 60 applies a sustaining pulse to the second trigger electrode TZ.

In the mean time, the data electrode X receives a data pulse synchronized with a scanning pulse from a data driver (not shown).

Referring now to FIG. 7, in the reset interval, a positive reset pulse Vrst having a high voltage level is applied to the second trigger electrode TZ. Then, the discharge cells at the entire field are reset-discharged to be initialized while creating a uniform amount of wall charge. The data electrode X is supplied with a positive pulse signal having a low voltage level to prevent an erroneous discharge from being generated between the second trigger electrode TZ and the data electrode X.

In the address interval, a scanning pulse—Vsc is sequentially applied to the first trigger electrodes TY. The data electrodes for one horizontal line are simultaneously supplied with a data pulse Vd synchronized with the scanning pulse—Vsc. The discharge cell supplied with the data pulse Vd causes an address discharge by a voltage difference between the data electrode X and the first trigger electrode TY and an internal wall voltage.

In the sustaining interval, a trigger pulse Vt and a sustaining pulse Vs are simultaneously applied to the first trigger electrode TY and the first sustaining electrode SY, respectively. Also, the trigger pulse Vt and the sustaining pulse Vs are simultaneously applied to the second trigger electrode TZ and the second sustaining electrode SZ, respectively. Herein, a voltage level of the trigger pulse Vt is set to be lower than that of the sustaining pulse Vs. When a first trigger pulse Vt is applied to the first trigger electrode TY, the discharge cells having generated the address discharge cause a short-path discharge between the first trigger electrode TY and the second trigger electrode TZ. By this short-path discharge, space charges and wall charges are created within the discharge cells selected by the address discharge. The space charges and the wall charges created by the short-path discharge provide a priming effect with respect to a long-path discharge between the first and second sustaining electrodes SY and SZ. In other words, the priming effect caused by the short-path discharge induces a long-path discharge between the first and second electrodes SY and SZ. In other words, the short-path discharge between the trigger electrodes TY and TZ can cause a long-path discharge between the sustaining electrodes SY and SZ having a wide distance between electrodes at a low voltage.

In the five-electrode PDP, the sustaining discharge is made at a long path to increase a quantity of ultraviolet rays generated by the discharge. Thus, a light-emission quantity of the fluorescent material 48 excited by the ultraviolet rays is increased to that extent, to thereby provide discharge and light-emission efficiencies higher than the three-electrode PDP.

However, in the conventional five-electrode PDP, since the first trigger electrode TY has a small width, it is difficult to accumulate a sufficient amount of wall charges into the first trigger electrode TY upon address discharge. If an amount of wall charges created upon address discharge is small, then an external application voltage required for a sustaining discharge is raised to that extent. As a result, the conventional five-electrode PDP has large power consumption and fails to obtain a satisfying discharge efficiency.

Furthermore, since the conventional five-electrode PDP fails to form sufficient wall charges upon address discharge, it has a problem of miss-writing in that a sustaining discharge does not occur.

In addition, in the conventional five-electrode PDP, since a voltage level of the trigger pulse Vt is different from that of the sustaining pulse Vs, the trigger pulses TY and TZ and the sustaining pulses SY and SZ should be driven individually. Thus, the conventional five-electrode PDP has a problem in that it has a complicated driving circuitry and a large manufacturing cost.

SUMMARY OF THE INVENTION

Accordingly, it is an object of the present invention to provide a plasma display panel (PDP) that is capable of preventing a miss-writing as well as improving discharge and light-emission efficiencies.

A further object of the present invention is to provide a method and apparatus for driving said PDP.

In order to achieve these and other objects of the invention, a plasma display panel according to one aspect of the present invention includes an upper substrate and a lower substrate opposed to each other with having a plurality of discharge cells therebetween; a first upper electrode group including at least one electrode having a desired width and formed on the upper substrate; a second upper electrode group including at least one electrode having a different width from the first upper electrode group and formed on the upper substrate in such a manner to be adjacent to the first upper electrode group; and a data electrode provided on the lower substrate in such a manner to be perpendicular to the first and second upper electrode group.

In the plasma display panel, the second upper electrode group has a larger width than the first upper electrode group. The first upper electrode group includes a first sustaining electrode provided adjacently to the second upper electrode group; and a second sustaining electrode spaced at a long distance from the second upper electrode group. The second upper electrode group includes at least one scanning electrode for causing an address discharge along with the data electrode to select the discharge cells, and for causing a short-path discharge along with the first sustaining electrode and causing a long-path discharge along with the second sustaining electrode with respect to the selected discharge cells.

In the plasma display panel, a distance between the scanning electrode and the first sustaining electrode is different from a distance between the first and second sustaining electrodes. Herein, a distance between the scanning electrode and the first sustaining electrode is larger than a distance between the first and second sustaining electrodes.

In the plasma display panel, each of the first and second upper electrode groups includes a large width of transparent electrode; and a metal bus electrode having a smaller width than the transparent electrode.

The plasma display panel further includes a light-shielding layer provided between the transparent electrode and the metal bus electrode.

In the plasma display panel, at least one electrode of the first and second upper electrode groups consists of only a metal bus electrode.

The plasma display panel further includes a light-shielding layer provided between the upper substrate and the metal bus electrode.

The plasma display panel further includes a barrier rib provided on the lower substrate to spatially separate the discharge cell; a dielectric layer formed on the upper substrate in such a manner to cover the first and second upper electrode groups; a protective film formed on the dielectric layer; and a fluorescent material layer coated on the barrier rib and the lower substrate. Herein, the barrier rib takes any one of strip and lattice shapes.

A method of driving a plasma display panel according to another aspect of the present invention includes the steps of providing a first upper electrode group including at least one electrode having a desired width; providing a second upper electrode group including at least one electrode having a width different from the first upper electrode group; causing an address discharge between a data electrode being perpendicular to the first and second upper electrode groups and at least one electrode of the first and second upper electrode groups to select a discharge cell; causing a short-path discharge between two electrodes spaced at a small distance from each other of said electrodes included in the first and second upper electrode groups; and causing a long-path discharge between two electrodes spaced at a larger distance than said electrodes causing said short-path discharge of the electrodes included in the first and second upper electrode groups from each other.

A driving apparatus for a plasma display panel according to still another aspect of the present invention includes said plasma display panel being provided with a first upper electrode group including at least one electrode having a desired width, a second upper electrode group including at least one electrode having a width different from the first upper electrode group, and a data electrode being perpendicular to said upper electrode groups; a data driver for applying a data pulse to the data electrode; a scanning driver for applying a scanning pulse synchronized with the data pulse to at least one electrode of the first and second upper electrode groups to cause an address discharge between the data electrode and said electrode supplied with the scanning pulse, thereby selecting the discharge cell; a short-path sustaining driver for causing a short-path discharge between two electrodes spaced at a small distance from each other, of said electrodes included in the first and second upper electrode groups; and a long-path sustaining driver for causing a long-path discharge between said two electrodes spaced at a larger distance than said distance between the electrodes causing the short-path discharge of said electrodes included in the first and second upper electrode groups.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
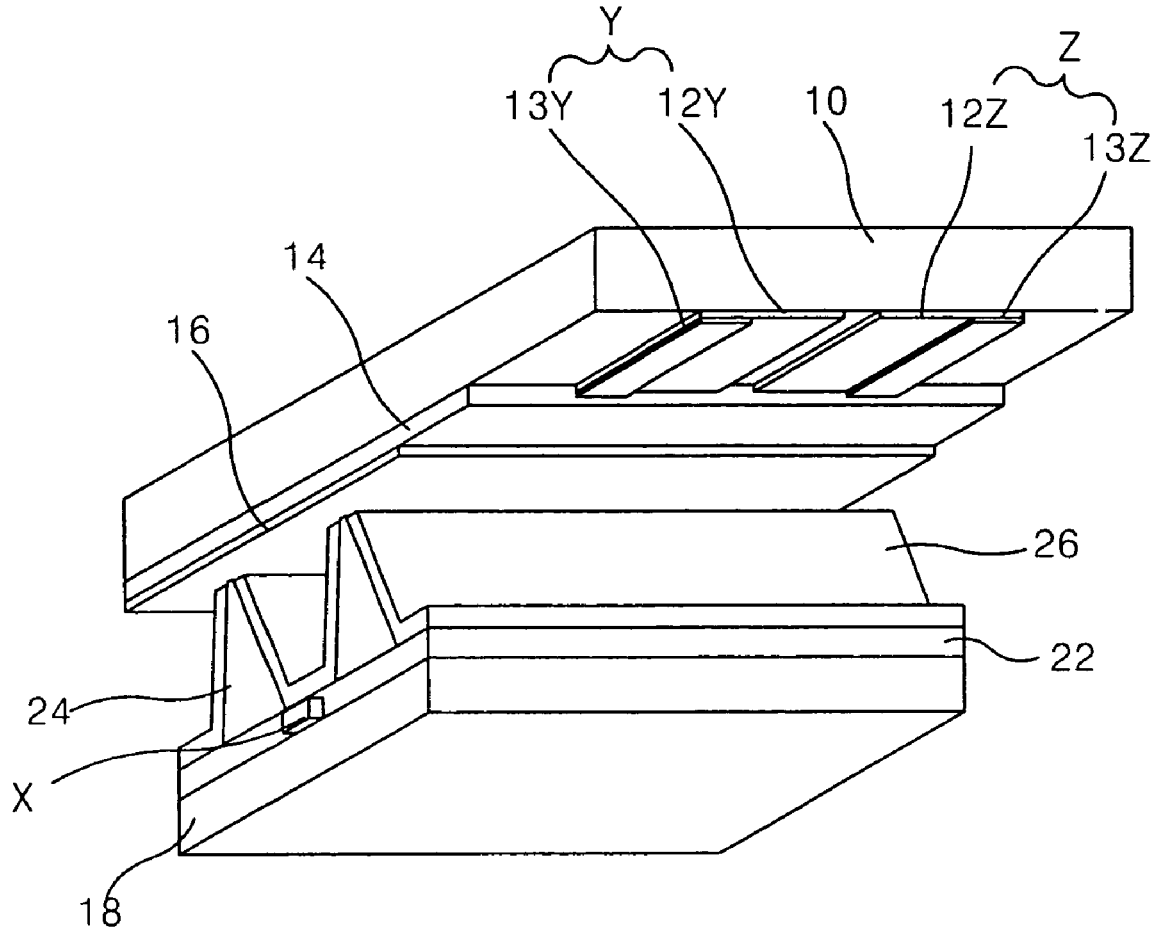
FIG. 1 CONVENTIONAL ART
FIG. 1 is a perspective view showing a structure of a discharge cell of a conventional three-electrode, AC surface-discharge plasma display panel.
Figure 2:
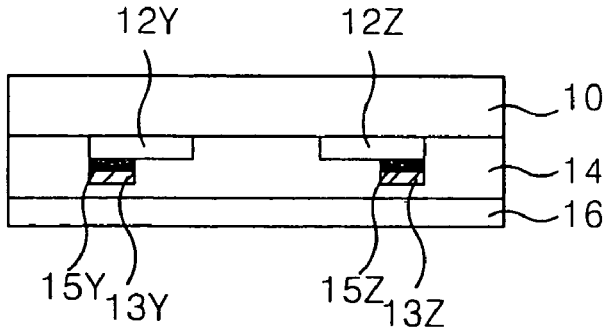
FIG. 2 CONVENTIONAL ART
FIG. 2 is a section view showing a structure of an upper plate of the three-electrode plasma display panel in FIG. 1.
Figure 3:
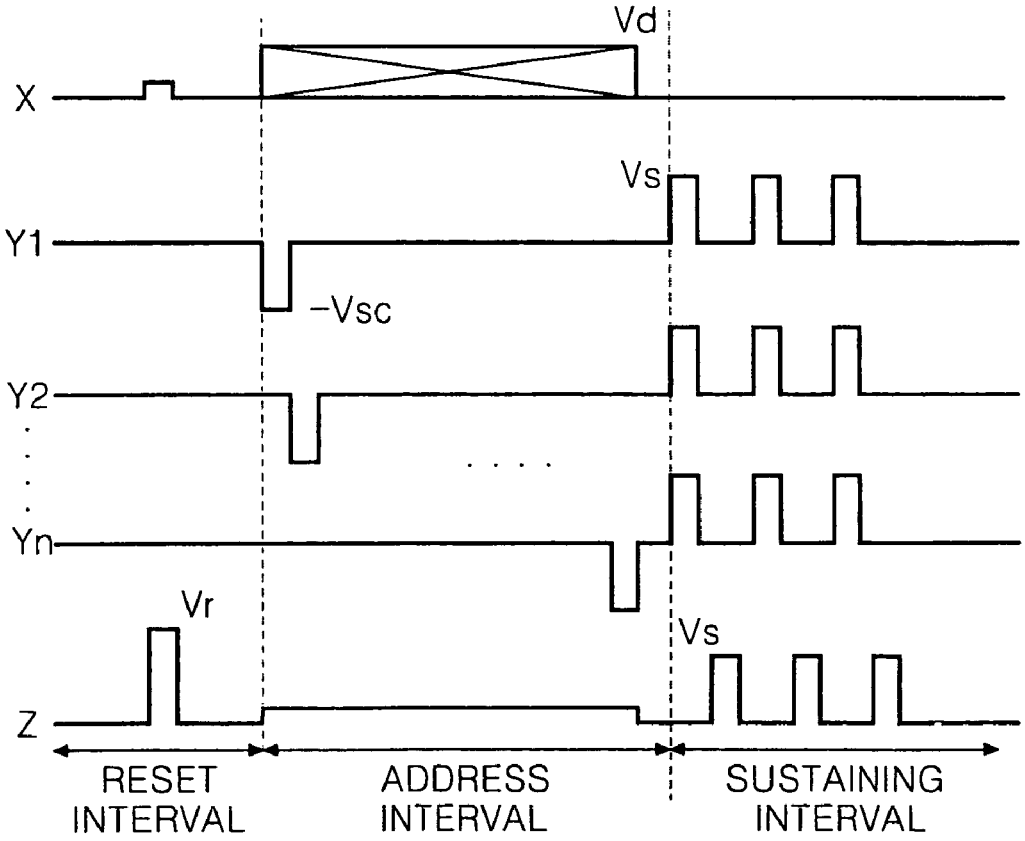
FIG. 3 CONVENTIONAL ART
FIG. 3 is a waveform diagram of driving signals for the three-electrode plasma display panel shown in FIG. 1.
Figure 4:
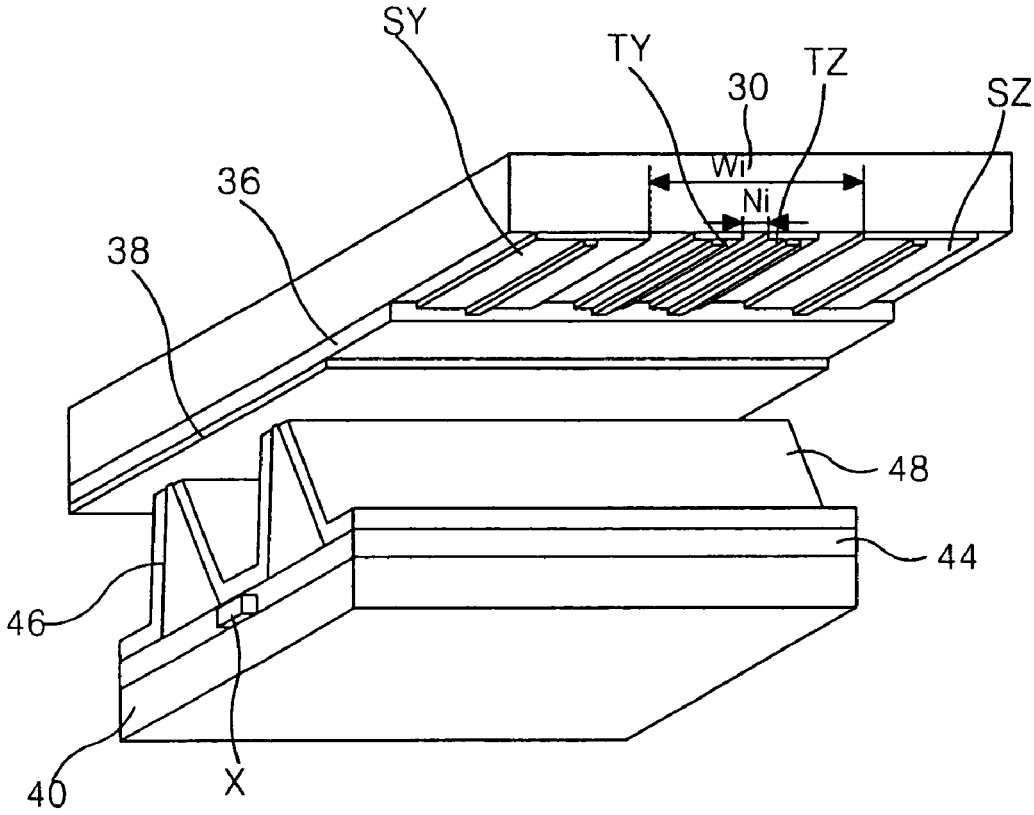
FIG. 4 CONVENTIONAL ART
FIG. 4 is a perspective view showing a structure of a discharge cell of a conventional five-electrode, AC surface-discharge plasma display panel.
Figure 5:
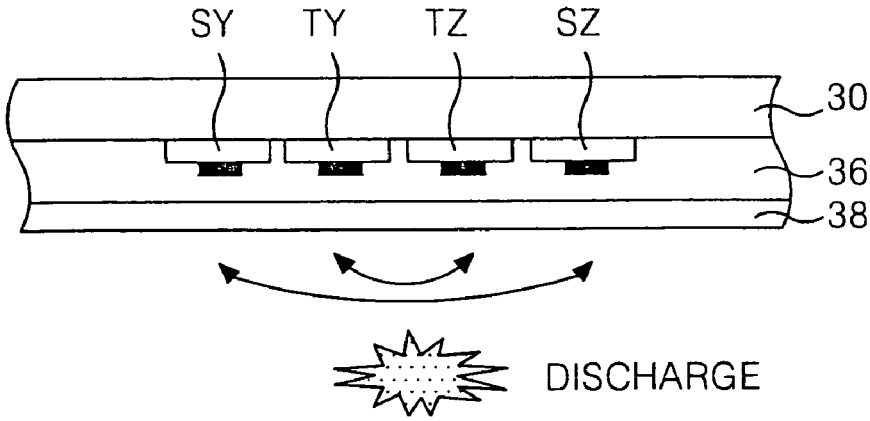
FIG. 5 CONVENTIONAL ART
FIG. 5 is a section view showing a structure of an upper plate of the five-electrode plasma display panel in FIG. 4.
Figure 6:
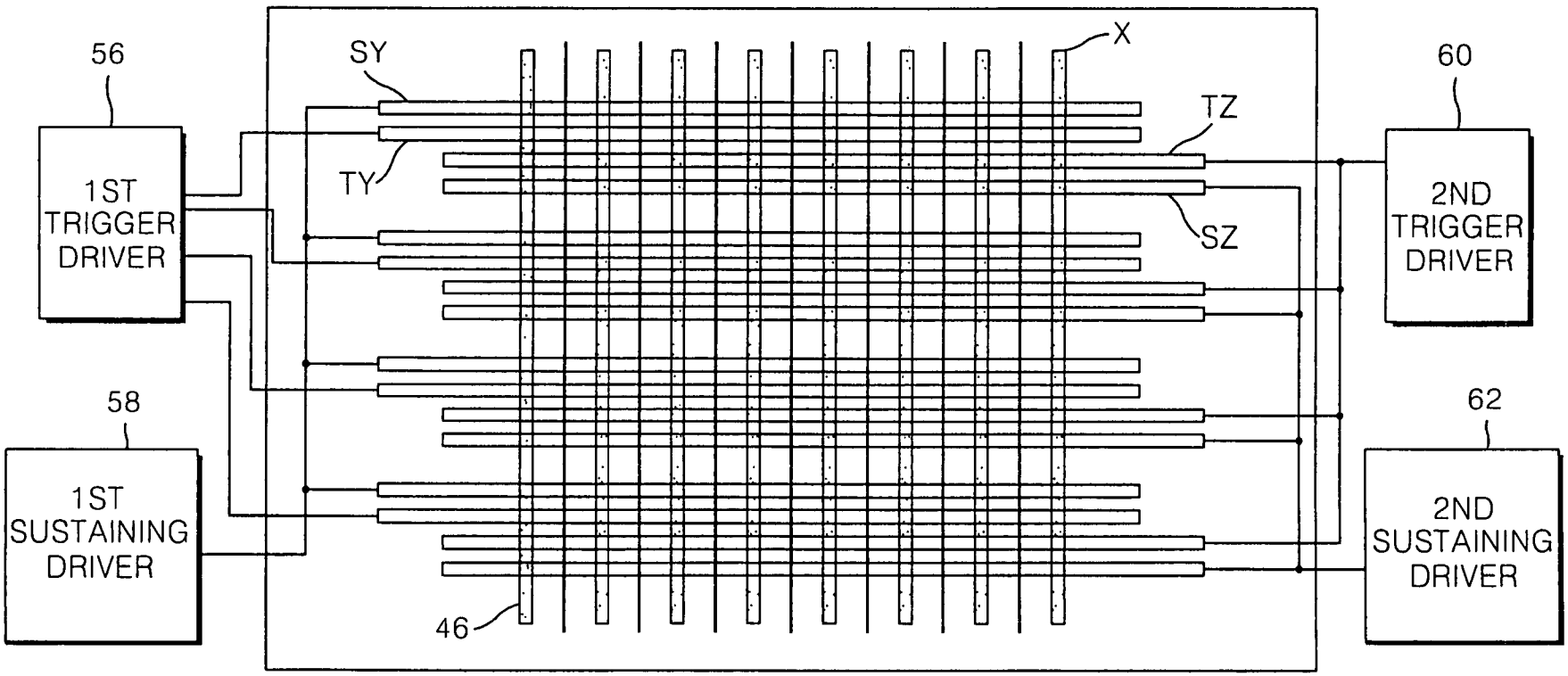
FIG.6 CONVENTIONAL ART
FIG. 6 is a block circuit diagram showing a configuration of the five-electrode plasma display panel in FIG. 4.
Figure 7:
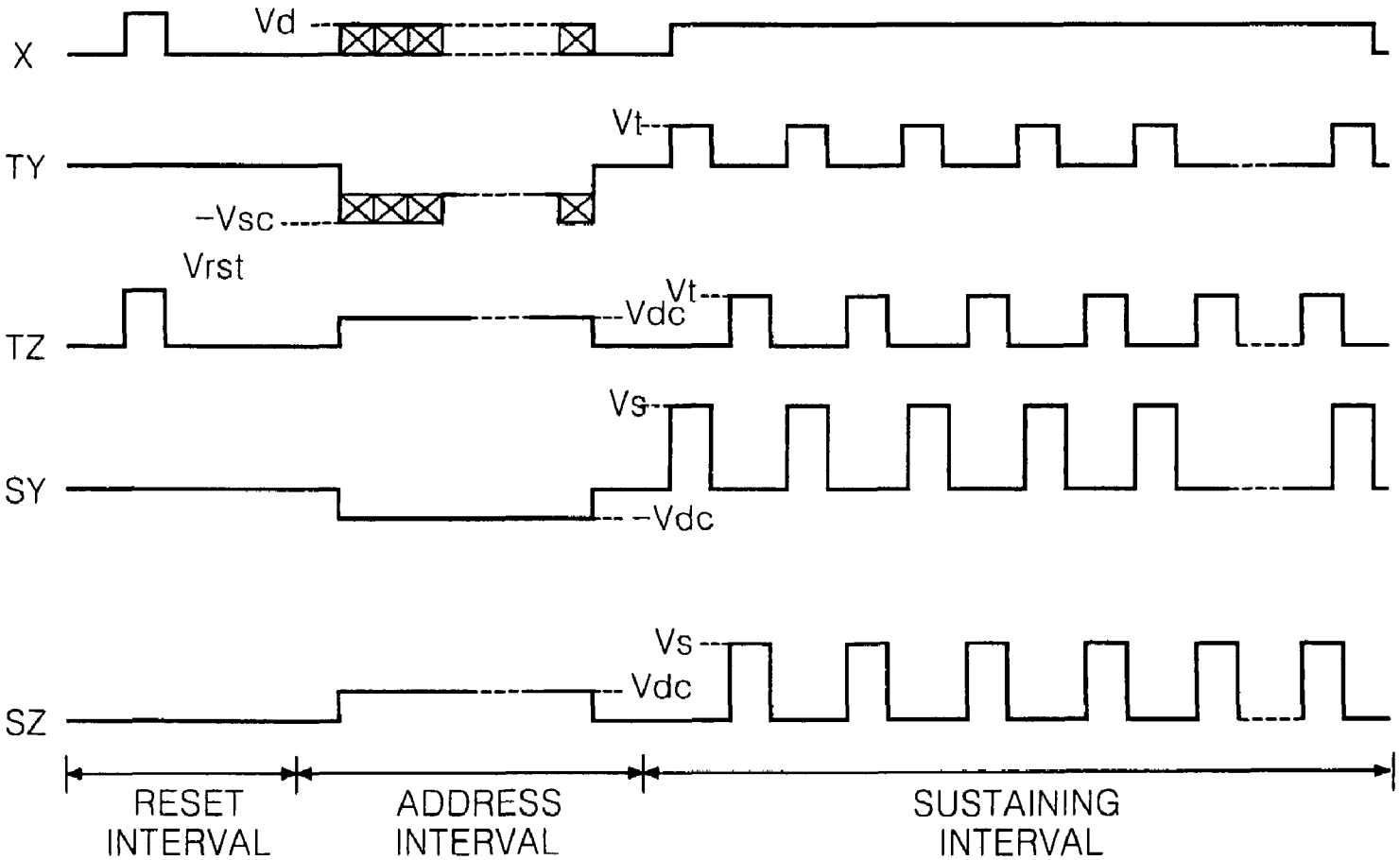
FIG. 7 CONVENTIONAL ART
FIG. 7 is a waveform diagram of driving signals for the five-electrode plasma display panel shown in FIG. 4.
Figure 8:
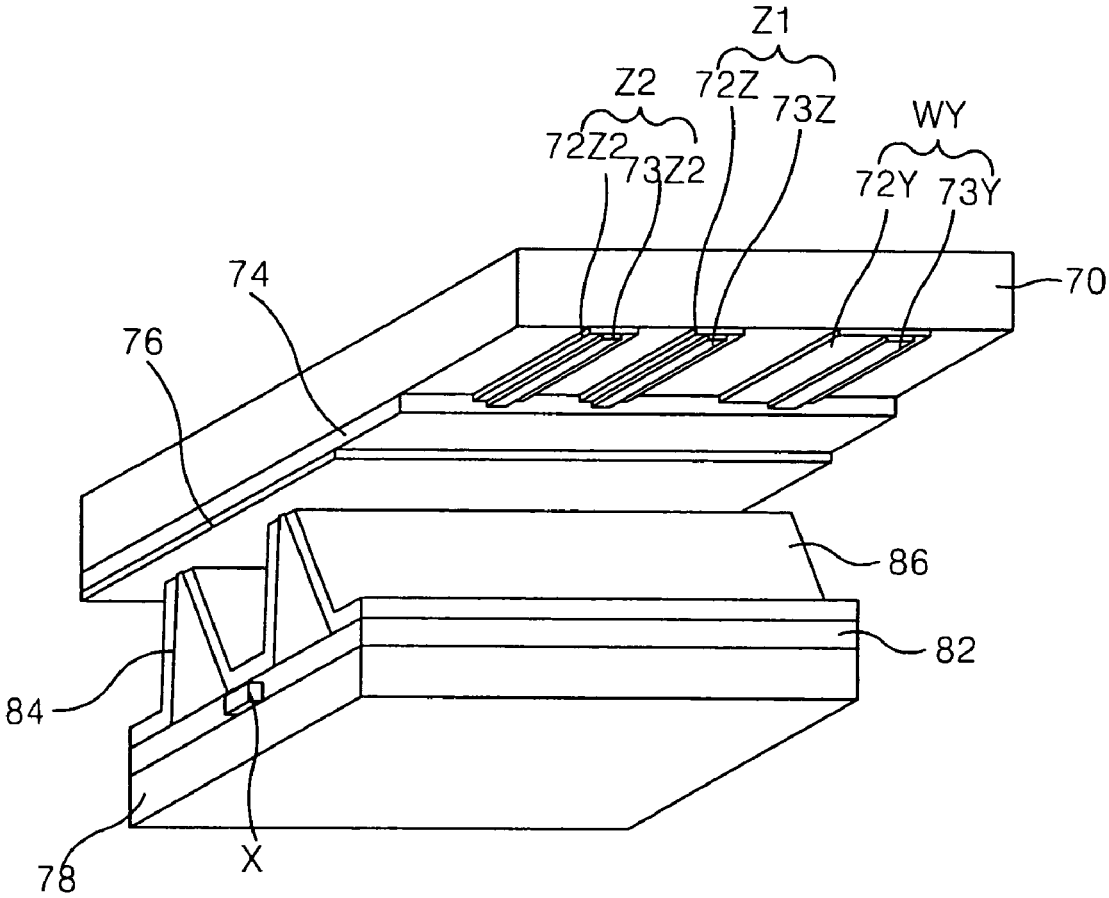
FIG. 8 is a perspective view showing a structure of a discharge cell of a plasma display panel according to a first embodiment of the present invention.
Figure 9:
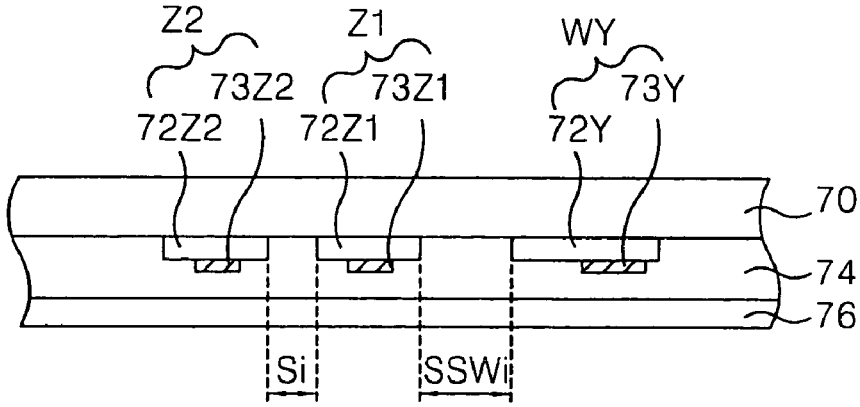
FIG. 9 is a section view showing a structure of an upper plate of the plasma display panel in FIG. 8.

Referring to FIG. 8 and FIG. 9, there is shown a plasma display panel (PDP) according to a first embodiment of the present invention.

The PDP includes a scanning electrode WY and first and second electrodes Z1 and Z2 formed on an upper substrate 70 in parallel to each other. A data electrode X is formed on a lower substrate 78 in a direction perpendicular to the scanning electrode WY and the first and second sustaining electrodes Z1 and Z2. The first electrode Z1 may include transparent electrode 72Z and metal bus electrode 73Z.

The first sustaining electrode Z1 is arranged between the scanning electrode WY and the second sustaining electrode Z2. A distance Si between the first and second sustaining electrodes Z1 and Z2 is set to be smaller than a distance SSWi between the scanning electrode WY and the first sustaining electrode Z1. Herein, the distance Si between the first and second sustaining electrodes Z1 and Z2 is selected within a range of 30 to 80 μm.

The scanning electrode WY includes a large width of transparent electrode 72Y and a small width of metal bus electrode 73Y. Alternately, the scanning electrode WY may consist of only a metal bus electrode having a large width. In the scanning electrode WY, a width of the transparent electrode 72Y is selected within a range of 100 to 300 μm while a width of the metal bus electrode 73Y is selected within a range of 50 to 120 μm. This scanning electrode WY selects the cells by an opposite discharge between it and the data electrode X. Further, the scanning electrode WY causes a short-path discharge at an initial time of the sustaining interval by the surface discharge between it and the first sustaining electrode Z1 and causes a sustaining discharge with respect to the second sustaining electrode Z2. To this end, the scanning electrode WY is supplied with a scanning pulse synchronized with a data pulse applied to the data electrode X in the address interval, and is supplied with a sustaining pulse in the sustaining interval.

The first and second sustaining electrodes Z1 and Z2 have a large width of transparent electrodes 72Z1 and 72Z2 and a small width of metal bus electrodes 73Z1 and 73Z2, respectively. In the sustaining electrodes Z1 and Z2, widths of the transparent electrodes 72Z1 and 72Z2 are smaller than those of the scanning electrode WY. The first sustaining electrode Z1 may consist of only a metal bus electrode 73Z1 without a transparent electrode 72Z1. In the sustaining electrodes Z1 and Z2, widths of the transparent electrodes 72Z1 and 72Z2 are selected within a range of 100 to 300 μm while widths of the metal bus electrodes 73Z1 and 73Z2 are selected within a range of 50 to 120 μm.

An upper dielectric layer 74 and a protective film 76 are disposed on the upper substrate 70 in such a manner to cover the scanning electrode WY and the sustaining electrodes Z1 and Z2. Wall charges generated upon plasma discharge are accumulated in the upper dielectric layer 74. The upper dielectric layer 74 preferably has a thickness of more than 25 μm for the purpose of limiting a discharge current. The protective film 76 prevents a damage of the upper dielectric layer 74 caused by a sputtering during the plasma discharge and improves the emission efficiency of secondary electrons. This protective film 76 is usually made from magnesium oxide (MgO).

A lower dielectric layer 82 and barrier ribs 84 are formed on the lower substrate 78. The surfaces of the lower dielectric layer 82 and the barrier ribs 84 are coated with a fluorescent material layer 86. The barrier ribs 84 takes a stripe shape such that adjacent discharge spaces in the horizontal direction are separated. The barrier ribs 84 prevent optical and electrical crosstalk between the discharge cells. The fluorescent material layer 86 is excited by an ultraviolet ray generated during the plasma discharge to generate any one of red, green and blue visible light rays. Alternately, the barrier rib 84 may be a lattice-shaped barrier rib surrounding the discharge cell in the vertical and horizontal direction such that discharge spaces between adjacent discharge cells in the horizontal and vertical direction are isolated. An inactive mixture gas of He+Xe or Ne+Xe is injected into a discharge space defined among the upper and lower substrate 70 and 78 and the barrier ribs 84.

The first and second sustaining electrodes Z1 and Z2 are separated from the same line and are commonly supplied with a sustaining pulse by means of the same driver. Alternately, the first and second sustaining electrodes Z1 and Z2 may be driven with different drivers such that they are supplied with a different voltage level of pulses.

The present PDP drives one frame, which is divided into various sub-fields having a different discharge frequency, so as to realize gray levels of a picture. Each sub-field is again divided into a reset interval for uniformly causing a discharge, an address interval for selecting the discharge cell and a sustaining interval for realizing the gray levels depending on the discharge frequency. In the address interval, the discharge cells are selected by an opposite discharge between the data electrode X and the scanning electrode WY. By this address discharge, wall charges are formed on the dielectric layer 74 covered on the scanning electrode WY and the sustaining electrodes Z1 and Z2. Wall charges increased in proportion to a width increase of the scanning electrode WY are formed on the dielectric layer 74 of the scanning electrode WY at which wall charges concentrate. As a result, a wall voltage of the discharge cell selected by the address discharge becomes high, so that a voltage required for a sustaining discharge can be lowered to that extent. Also, a stable sustaining discharge of the selected discharge cell is made, so that a miss-writing can be prevented.

In the sustaining interval, a primary discharge is caused between the scanning electrode WY and the first sustaining electrode SZ1 by a wall voltage within the discharge cell selected by the address discharge and a sustaining pulse applied to the scanning electrode WY. Further, a long-path discharge is continuously generated between the scanning electrode WY and the second sustaining electrode Z2 by a priming effect caused by the first short-path discharge and a sustaining pulse applied alternately to the sustaining electrodes Z1 and Z2. The priming effect caused by the first short-path discharge lowers a voltage at a long-path discharge occurring between the scanning electrode WY and the second sustaining electrode Z2.

FIG. 10A to FIG. 10D represent a discharge process in the sustaining interval step by step.

Figure 10A:
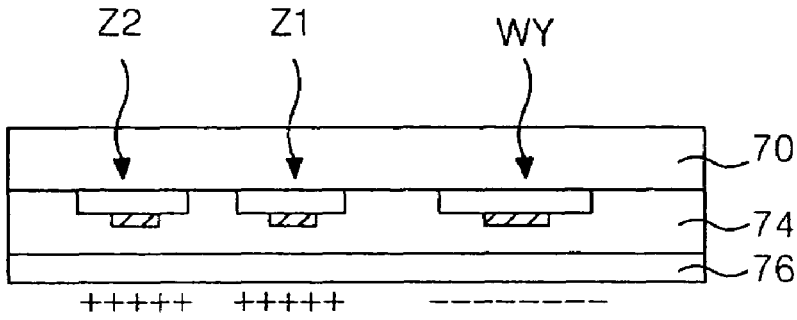
FIG. 10A to FIG. 10D are section views for representing a discharge process between the scanning electrode and the sustaining electrode in FIGS. 8 and 9 step by step.
Figure 10B:
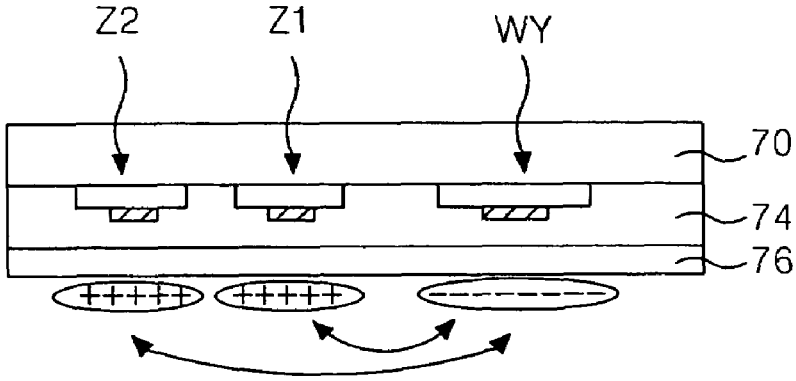
Figure 10C:
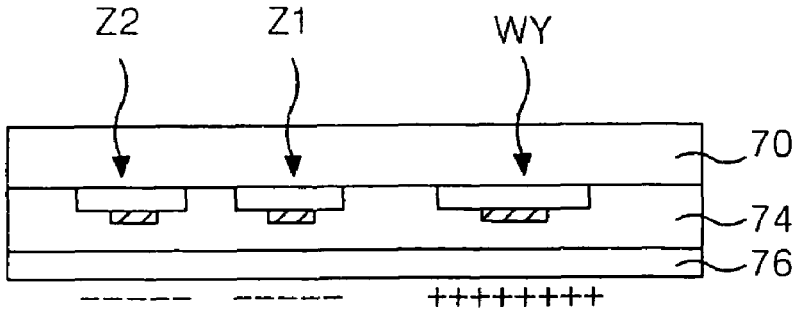
Figure 10D:
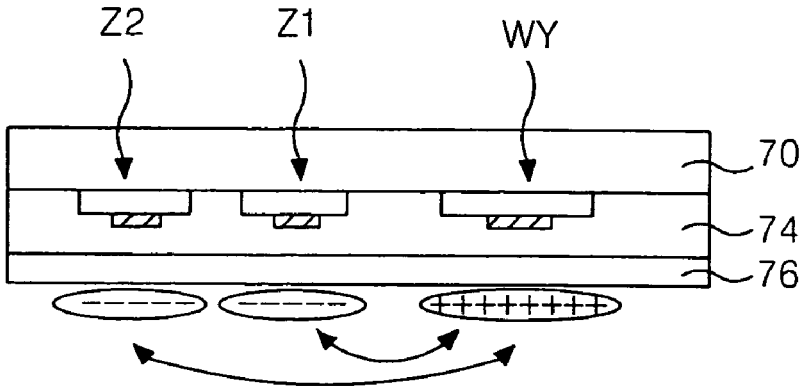

First, in an initial time of the sustaining interval, a positive sustaining pulse is applied to the scanning electrode WY. Then, as shown in FIG. 10A, negative wall charges are formed on the scanning electrode WY while positive wall charges are formed on the sustaining electrodes Z1 and Z2 by a relative potential difference between each of them and the scanning electrode WY. By a potential difference between the first sustaining electrode Z1 and the scanning electrode WY, a short-path discharge is generated between the first sustaining electrode Z1 and the scanning electrode WY as shown in FIG. 10B. Almost simultaneously, a long-path discharge is generated between the second sustaining electrode Z2 and the scanning electrode WY by utilizing a priming effect caused by the short-path discharge between the first sustaining electrode Z1 and the scanning electrode WY. If one sustaining discharge occurs in this manner, then the polarity of wall charges formed on the sustaining electrodes Z1 and Z2 and the scanning electrode WY are inverted as shown in FIG. 10C. If a second positive sustaining pulse is applied to the sustaining electrodes Z1 and Z2, then a short-path discharge is generated between the first sustaining electrode Z1 and the scanning electrode WY while a long-path discharge is generated between the second sustaining electrode Z2 and the scanning electrode WY at a low voltage by utilizing the priming effect, as shown in FIG. 10D.

In the present PDP, a distance between the scanning electrode WY and the second sustaining electrode Z2 becomes large, so that a positive column area emerges upon discharge to improve discharge efficiency and brightness. This will be described in detail in conjunction with a potential distribution according to a glow discharge tube and a discharge area in FIG. 11.

Figure 11:
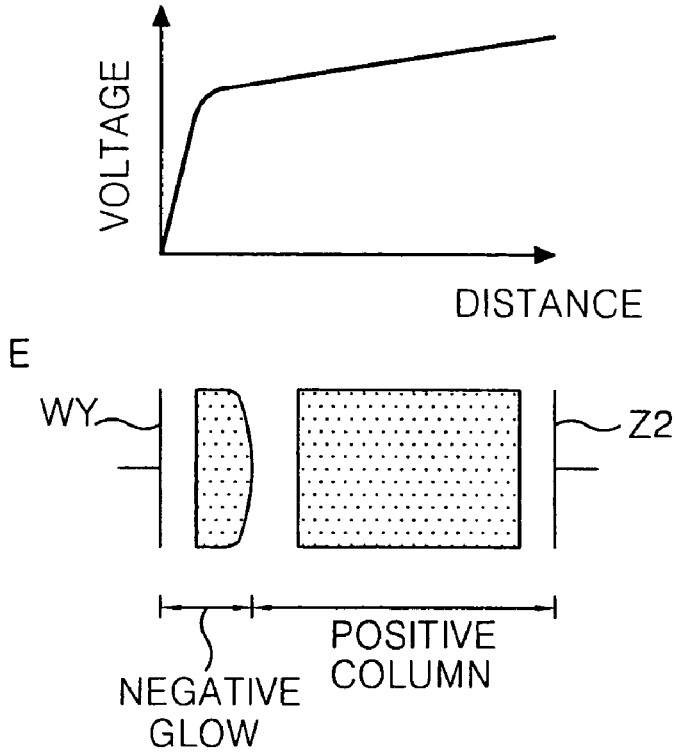
FIG. 11 illustrates a positive column area used upon discharge between the scanning electrode and the sustaining electrode in FIGS. 8 and 9.

As can be seen from FIG. 11, a voltage is largely increased at a negative glow area. On the other hand, a positive column area has a voltage kept almost constantly as end a high brightness. As a result, since a discharge occurs at the positive column area between the scanning electrode WY and the second sustaining electrode Z2 which have a wide distance between electrodes, power consumption is reduced in spite of an increase of light-emission bulk.

In other words, the present PDP can create sufficient wall charges because a width of the scanning electrode WY is large, and has a high efficiency because a distance between the scanning electrode WY and the second sustaining electrode Z2 is large.

Figure 12:
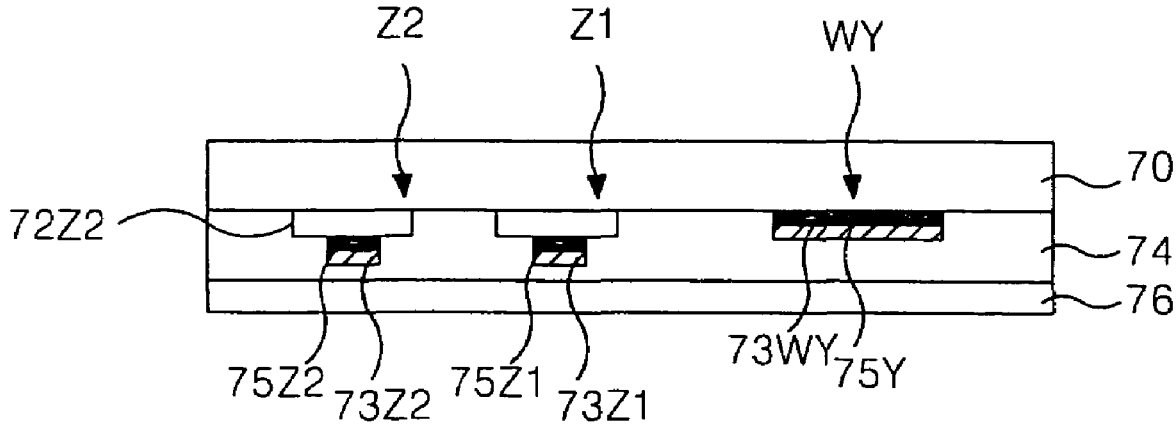
FIG. 12 is a section view of a light-shielding layer provided on the metal bus electrode in the plasma display panel shown in FIG. 8.

Meanwhile, when the scanning electrode WY consists of only a large width of metal bus electrode 73WY, a light-shielding layer 75Y are provided between the metal bus electrode 73WY and the upper substrate 70 as shown in FIG. 12 for the purpose of preventing a contrast deterioration caused by a reflection of an external light. Similarly, in the first and second sustaining electrodes Z1 and Z2, conductive light-shielding layers 75Z1 and 75Z2 are provided between the metal bus electrodes 73Z1 and 73Z2 and the upper substrate 70. Herein, the light-shielding layers 75Y, 75Z1 and 75Z2 have an electrical conductive property.

Figure 13:
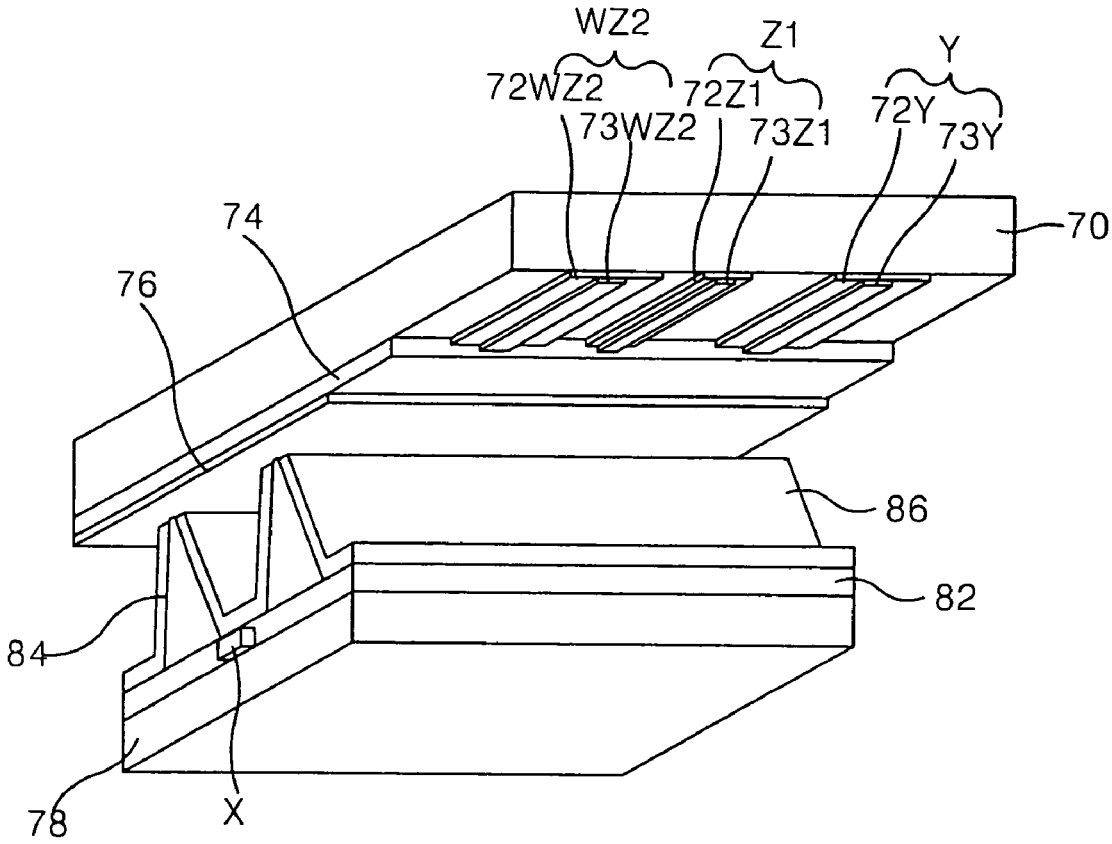
FIG. 13 is a perspective view showing a structure of a discharge cell of a plasma display panel according to a second embodiment of the present invention.
Figure 14:
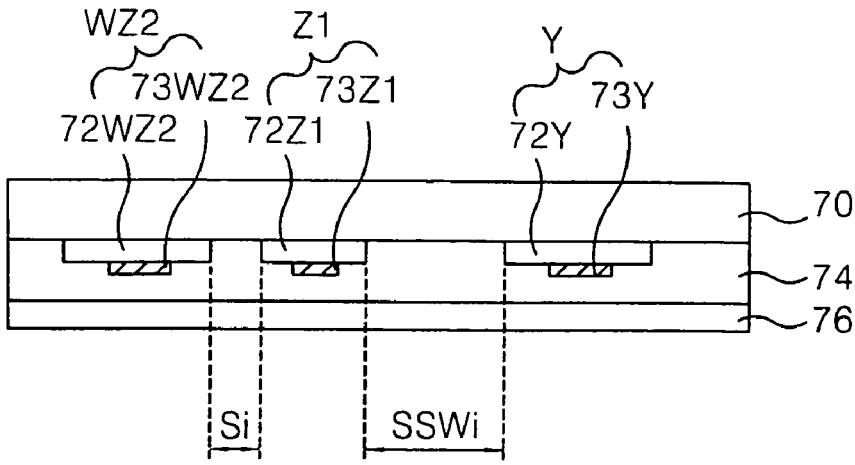
FIG. 14 is a section view showing a structure of an upper plate of the plasma display panel in FIG. 13.

FIG. 13 and FIG. 14 show a PDP according to a second embodiment of the present invention.

Referring to FIG. 13 and FIG. 14, in the PDP according to the second embodiment, a width of a first sustaining electrode Z1 is set to be different from that of a second sustaining electrode WZ2. The second sustaining electrode WZ2 has a large width of transparent electrode 72WZ2 and a small width of metal bus electrode 73WZ2. In the second sustaining electrode WZ2, a width of the transparent electrode 72WZ2 is set to be larger than that of the transparent electrode 72Z1 of the first sustaining electrode Z1 such that an amount of wall charges accumulated in the dielectric layer 74 upon discharge is increased and a discharge path has a longer distance.

The PDP according to the second embodiment has the substantially identical elements and functions with respect to the PDP shown in FIG. 8 and FIG. 9 except that widths of the sustaining electrodes Z1 and ZW2 are different from each other.

Figure 15:
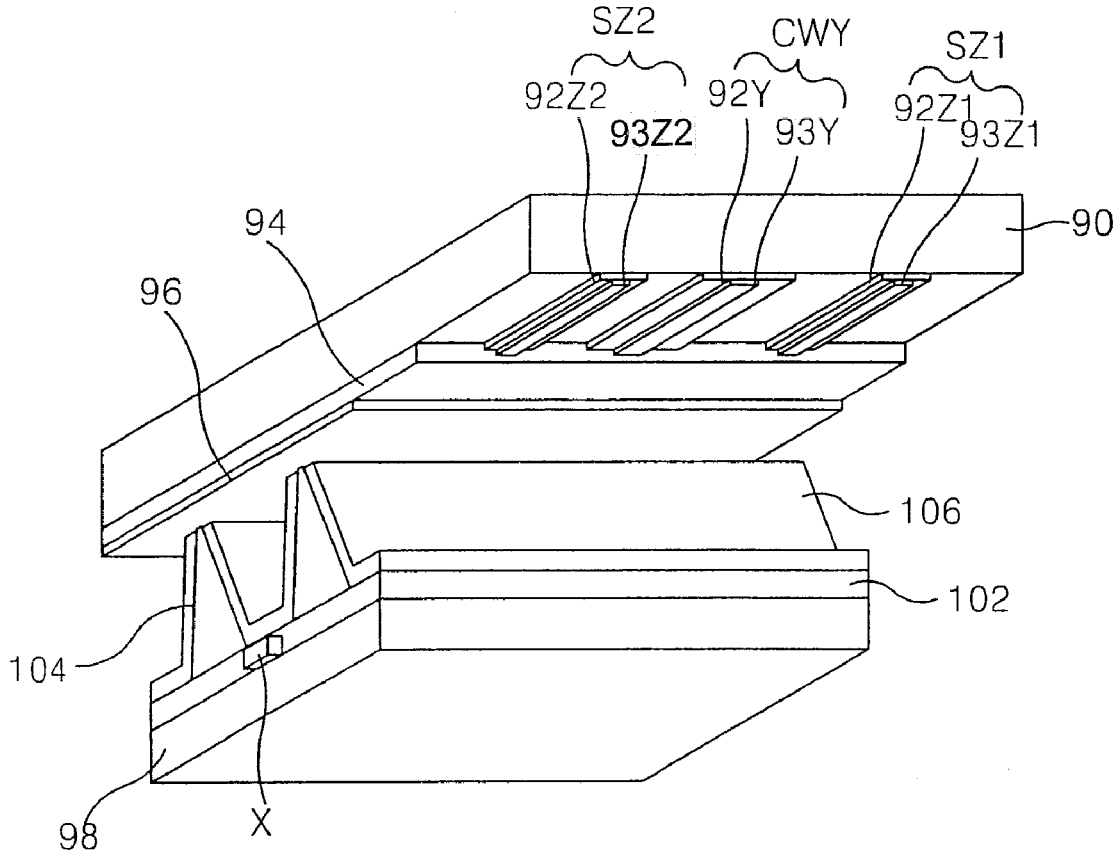
FIG. 15 is a perspective view showing a structure of a discharge cell of a plasma display panel according to a third embodiment of the present invention.
Figure 16:
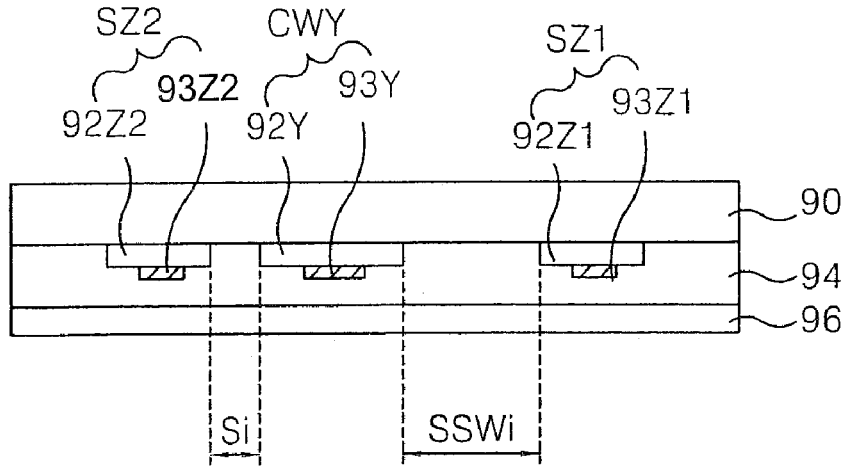
FIG. 16 is a section view showing a structure of an upper plate of the plasma display panel in FIG. 15.

FIG. 15 and FIG. 16 show a PDP according to a third embodiment of the present invention.

Referring to FIG. 15 and FIG. 16, in the PDP according to the third embodiment, first and second sustaining electrodes SZ1 and SZ2 are formed on an upper substrate in parallel to each other with having a large width of scanning electrode CWY therebetween. A data electrode X is formed on a lower substrate 98 in a direction perpendicular to the scanning electrode CWY and the first and second sustaining electrodes SZ1 and SZ2.

The scanning electrode CWY and the sustaining electrodes SZ1 and SZ2 have a large width of transparent electrodes 92Y, 92Z1 and 92Z2 and a small width of metal bus electrodes 93Y, 93Z1 and 93Z2, respectively. In the sustaining electrodes SZ1 and SZ2, widths of the transparent electrodes 92Z1 and 02Z2 are smaller than a width of the scanning electrode CWY. A distance Si between the scanning electrode CWY and the second sustaining electrode SZ2 is set to be smaller than a distance SSWi between the scanning electrode CWY and the first sustaining electrode SZ1. The scanning electrode CWY selects the cells by an opposite discharge between it and the data electrode X. Further, the scanning electrode CWY causes a short-path discharge at an initial time of the sustaining interval by the surface discharge between it and the second sustaining electrode SZ2 while causing a long-path discharge with respect to the first sustaining electrode SZ1. To this end, the scanning electrode CWY is supplied with a scanning pulse synchronized with a data pulse applied to the data electrode X in the address interval, and is supplied with a sustaining pulse in the sustaining interval.

An upper dielectric layer 94 and a protective film 96 are disposed on the upper substrate 90 in such a manner to cover the scanning electrode CWY and the sustaining electrodes SZ1 and SZ2.

A lower dielectric layer 102 and barrier ribs 104 are formed on the lower substrate 98. The surfaces of the lower dielectric layer 102 and the barrier ribs 104 are coated with a fluorescent material layer 106. The barrier ribs 104 take a stripe shape or a lattice shape. An inactive mixture gas of He+Xe or Ne+Xe is injected into a discharge space defined among the upper and lower substrate 90 and 98 and the barrier ribs 104.

A discharge in the sustaining interval are made as follows:

In an initial time of the sustaining interval, a short-path discharge is generated by a potential difference between the scanning electrode CWY and the second sustaining electrode SZ2 in which a distance between electrodes is small. By utilizing a priming effect caused by this short-path discharge, a long-path discharge is generated continuously whenever a sustaining pulse is alternately applied to the scanning electrode CWY and the first sustaining electrode SZ1.

Figure 17:
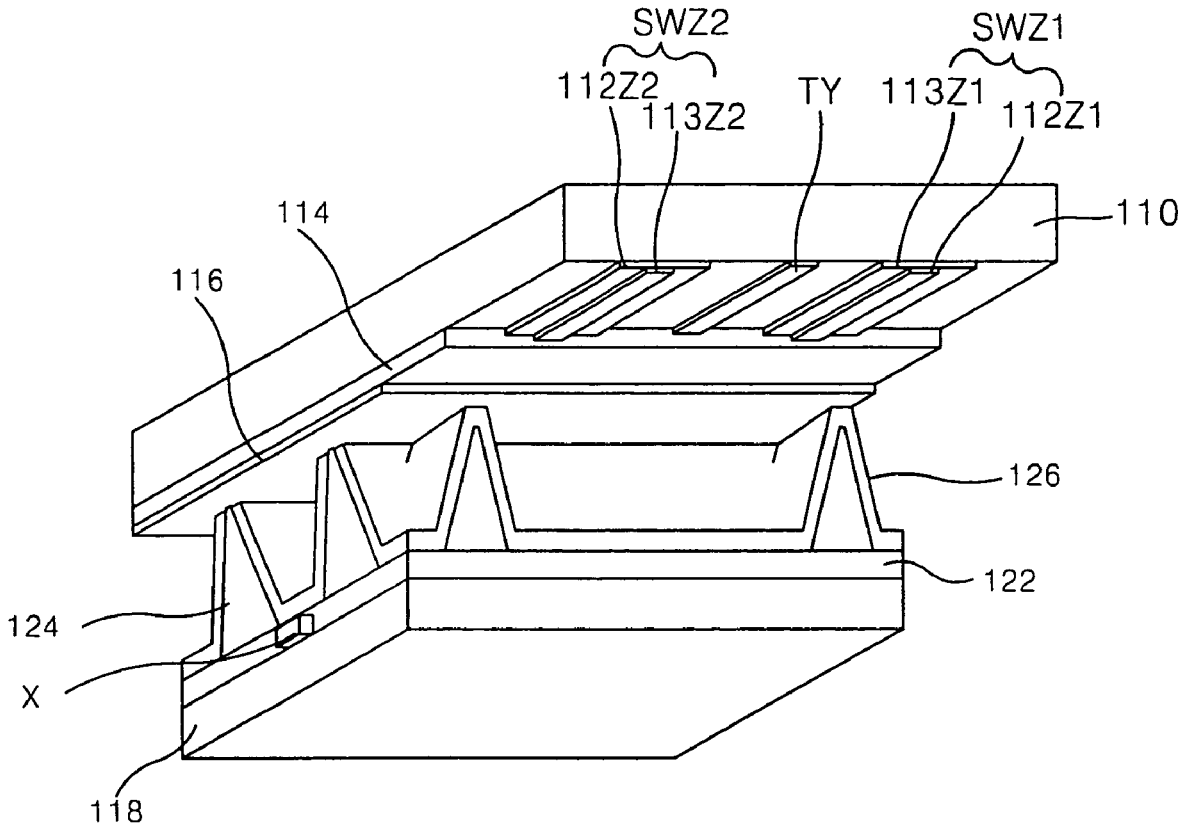
FIG. 17 is a perspective view showing a structure of a discharge cell of a plasma display panel according to a fourth embodiment of the present invention.
Figure 18:
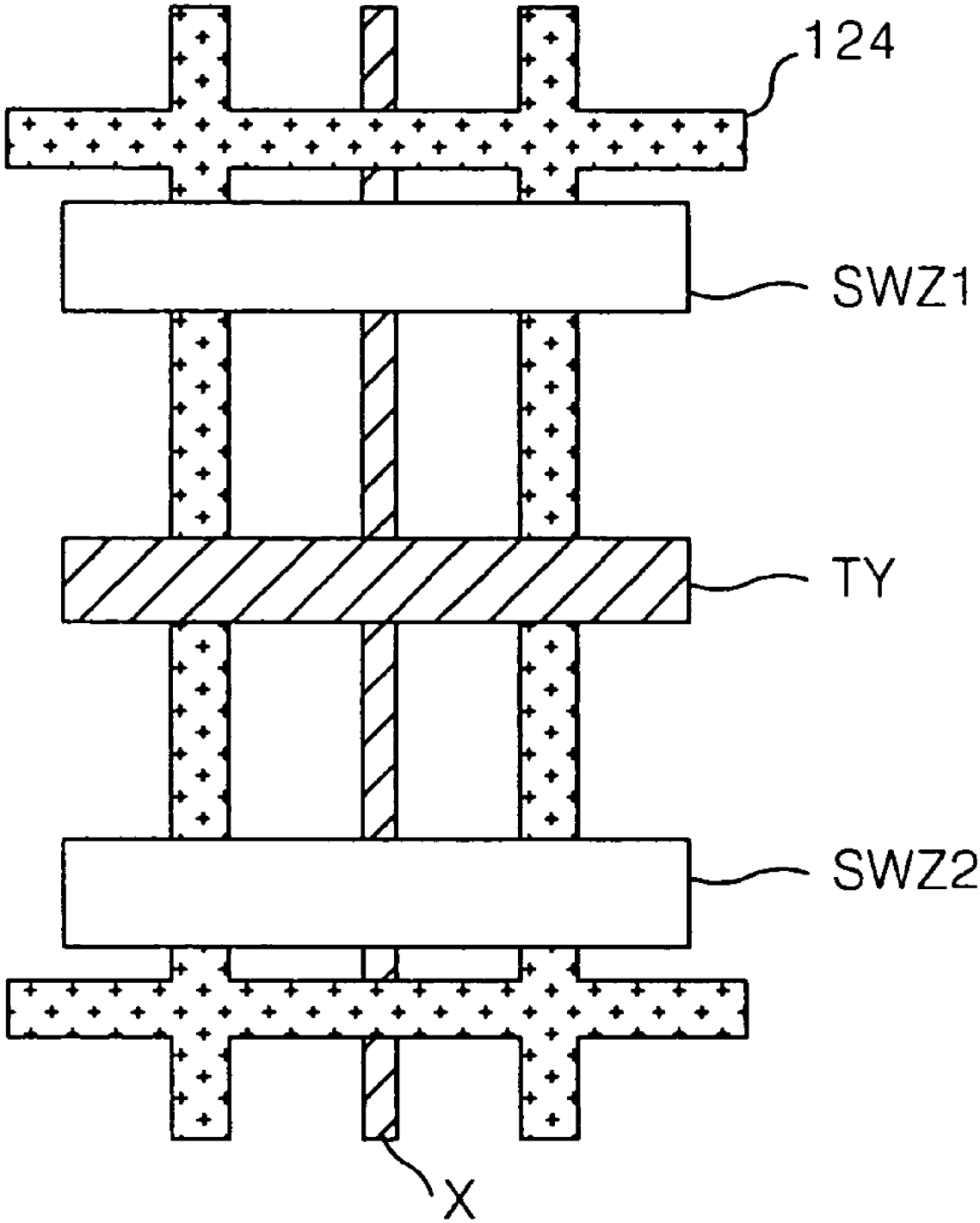
FIG. 18 is a section view showing a structure of an upper plate of the plasma display panel in FIG. 17.

FIG. 17 and FIG. 18 show a PDP according to a fourth embodiment of the present invention.

Referring to FIG. 17 and FIG. 18, the PDP according to the fourth embodiment includes first and second sustaining electrodes SWZ1 and SWZ2 formed on an upper substrate 110 in such a manner to be arranged at each edge of a discharge cell with having a scanning/trigger electrode TY positioned at the center of the discharge cell therebetween. A data electrode X is formed on a lower substrate 122 in a direction perpendicular to the scanning/trigger electrode TY and the first and second sustaining electrodes SWZ1 and SWZ2.

The scanning/trigger electrode TY consists of a small width of metal bus electrode. Alternately, the scanning/trigger electrode TY may have a large width of transparent electrode and a small width of metal bus electrode. The scanning/trigger electrode TY is spaced at an equal distance from the first and second sustaining electrodes SWZ1 and SWZ2 being adjacent to each other at the left and right sides thereof. The scanning/sustaining electrode TY causes an address discharge along with the data electrode X and causes a short-path discharge at an initial time of the sustaining interval along with any one of the first and second sustaining electrodes SWZ1 and SWZ2.

The first and second sustaining electrodes SWZ1 and SWZ2 have a large width of transparent electrodes 112Z1 and 112Z2 and a small width of metal bus electrodes 113Z1 and 113Z2, respectively. The first and second sustaining electrodes SWZ1 and SWZ2 are arranged at each edge of the discharge cell to continuously cause a sustaining discharge in response to a sustaining pulse applied alternately. A voltage required for this sustaining discharge is lowered because a priming effect caused by the short-path discharge between the trigger electrode TY and the data electrode X.

An upper dielectric layer 114 and a protective film 116 are disposed on the upper substrate 110 in such a manner to cover the scanning/trigger electrode TY and the sustaining electrodes SWZ1 and SWZ2. Wall charges generated upon plasma discharge are accumulated in the upper dielectric layer 114. The protective film 116 prevents a damage of the upper dielectric layer 114 caused by a sputtering during the plasma discharge and improves the emission efficiency of secondary electrons. This protective film 116 is usually made from magnesium oxide (MgO).

A lower dielectric layer 122 and barrier ribs 124 are formed on the lower substrate 118. The surfaces of the lower dielectric layer 122 and the barrier ribs 124 are coated with a fluorescent material layer 126. The barrier ribs 124 take a lattice shape. Alternately, the barrier ribs 124 may take a stripe shape. An inactive mixture gas of He+Xe or Ne+Xe is injected into a discharge space defined among the upper and lower substrate 110 and 118 and the barrier ribs 124.

The first and second sustaining electrodes SWZ1 and SWZ2 are alternately supplied with a sustaining pulse for the purpose of causing a sustaining discharge. When arrangement sequences of the first and second sustaining electrodes SWZ1 and SWZ2 of the adjacent discharge cells in the vertical direction are identical, an erroneous discharge between the adjacent discharge cells in the vertical direction may occur because a level difference of voltages applied to the first and second sustaining electrodes SWZ1 and SWZ2 opposed to the adjacent discharge cells in the vertical direction have a magnitude capable of causing a discharge. In order to prevent such an erroneous discharge, it is desirable that the first and second sustaining electrodes SWZ1 and SWZ2 have a contrary arrangement sequence between the adjacent discharge cells in the vertical direction. This is applicable to the above-mentioned embodiments.

Figure 19:
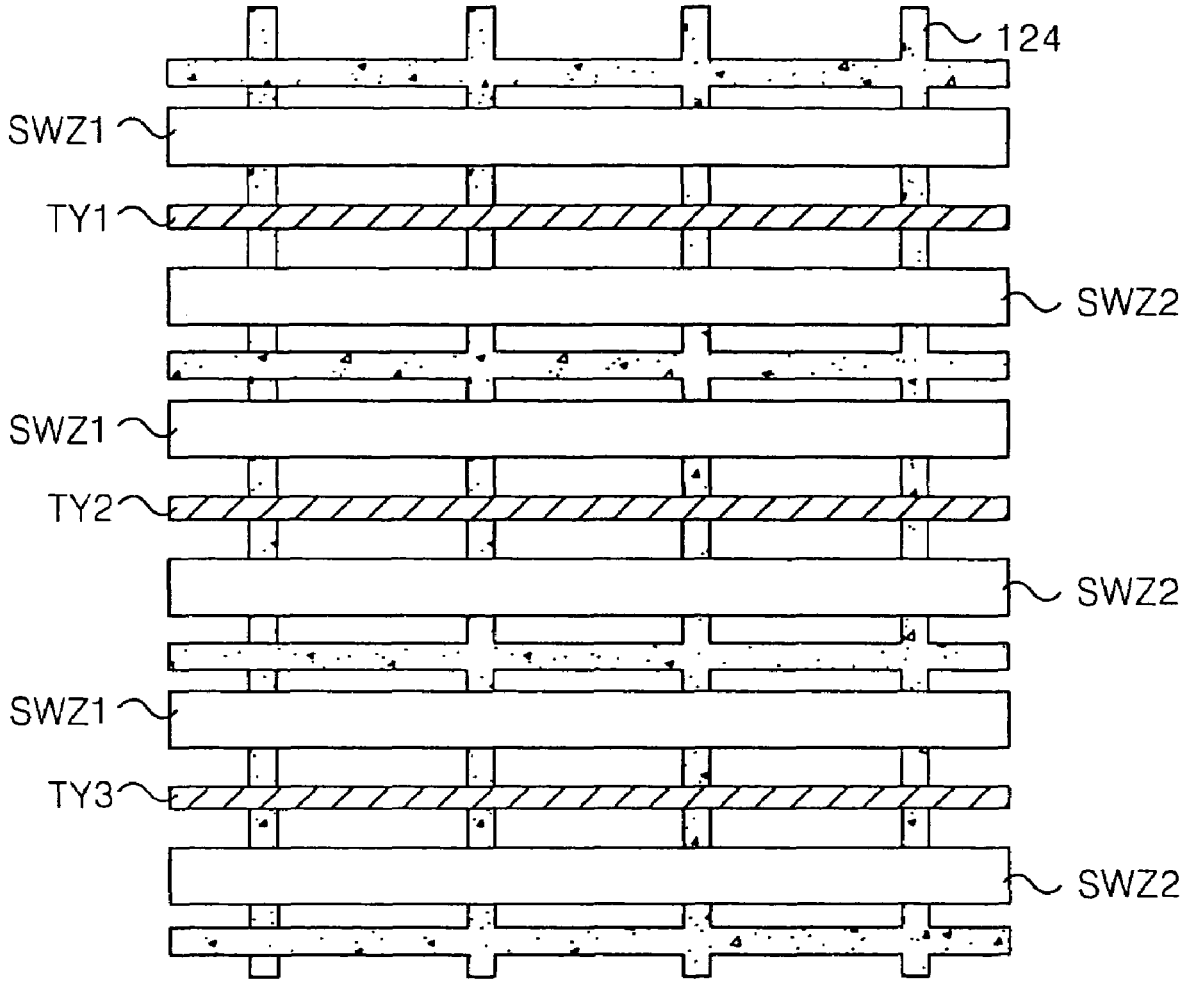
FIG. 19 is a plan view showing an electrode arrangement when lattice-shape barrier ribs are applied to the plasma display panel of FIG. 17.
Figure 20:
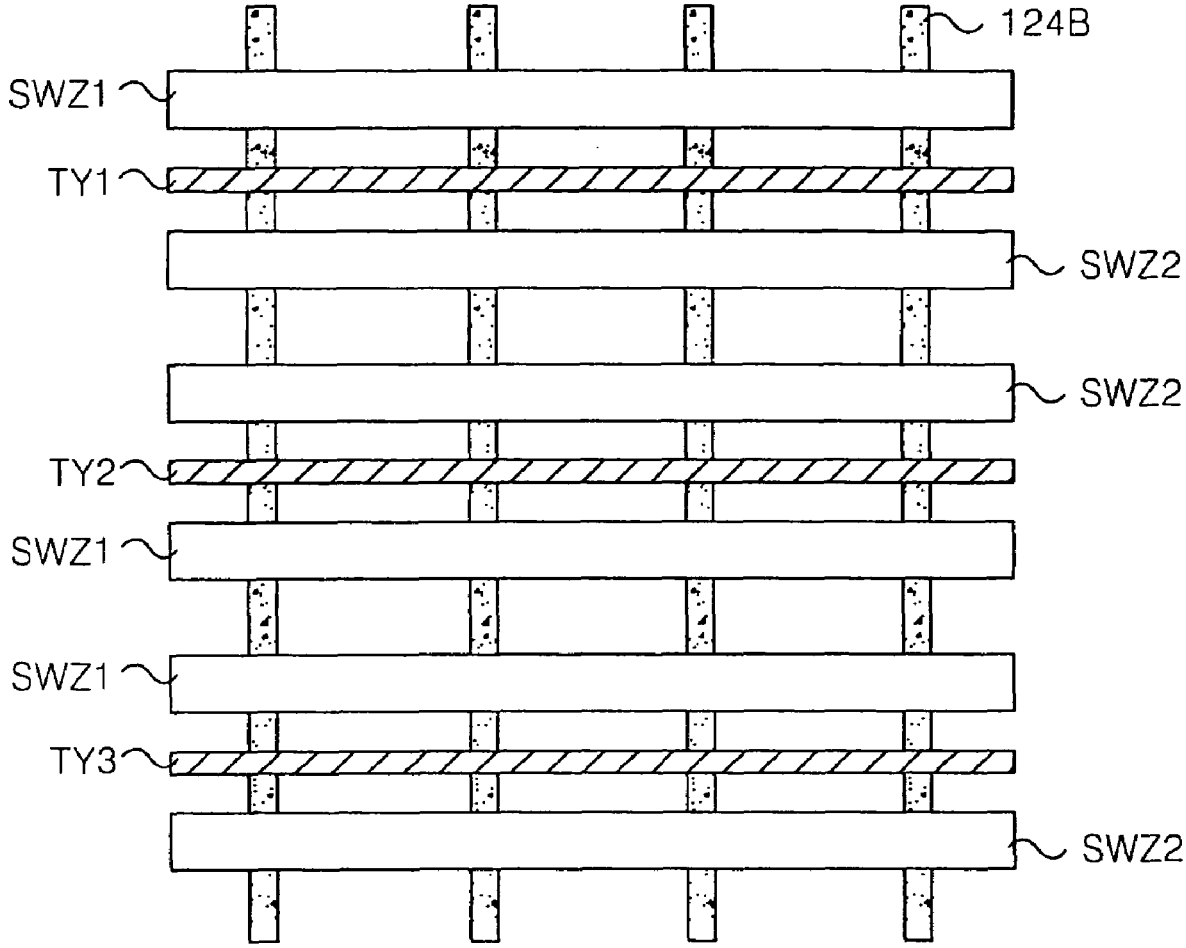
FIG. 20 is a plan view showing an electrode arrangement when stripe-shape barrier ribs are applied to the plasma display panel of FIG. 17.

If lattice-shaped barrier ribs 124 are applied, then the discharge cells in the horizontal and vertical directions are isolated from each other. Thus, it becomes difficult to cause a discharge between the adjacent discharge cells in the horizontal and vertical directions. Accordingly, when the lattice-shape barrier ribs are applied, an arrangement in a sequence of the first sustaining electrode SWZ1—the scanning/trigger electrode TY—the second sustaining electrode SWZ2 as shown in FIG. 19 will do.

If stripe-shaped barrier ribs 124B are applied, then a movement of space charges between the adjacent discharge cells in the vertical direction becomes free and an insulating material does not exist. When the stripe-shaped barrier ribs 124B are applied and the first sustaining electrode SWZ1 is adjacent to the second sustaining electrode SWZ2 between the adjacent discharge cells in the vertical direction, an erroneous discharge may occur because a potential difference capable of causing a discharge therebetween emerges. Accordingly, when the stripe-shaped barrier ribs 124B are applied, the electrodes of the two adjacent discharge cells in the vertical direction should have an arrangement in a sequence of the first sustaining electrode SWZ1—the scanning/trigger electrode TY1—the second sustaining electrode SWZ2—the second sustaining electrode SWZ2 the scanning/trigger electrode TY2—the first sustaining electrode SWZ1.

Figure 21:
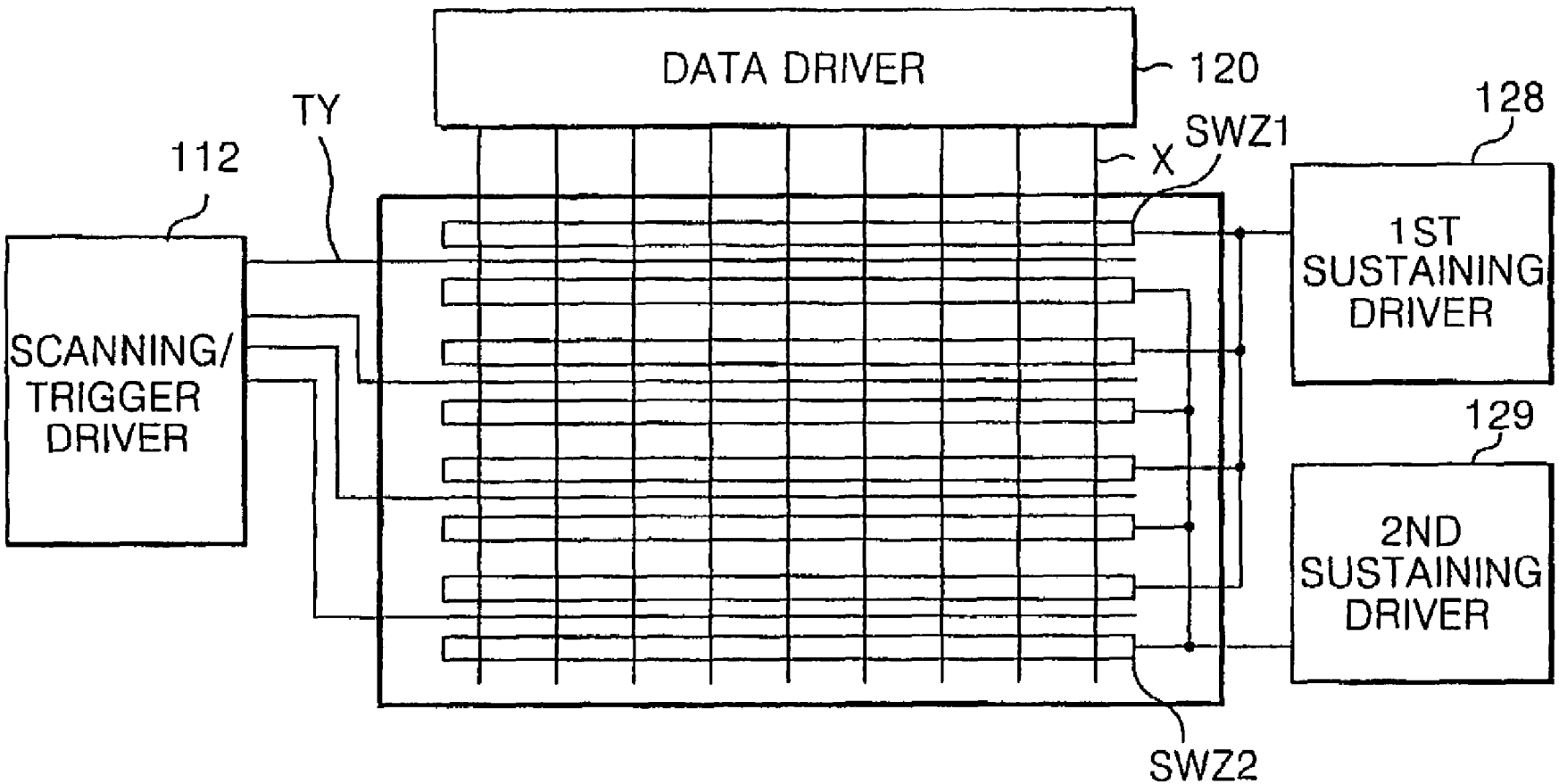
FIG. 21 is a block circuit diagram showing a configuration of a driving apparatus for the plasma display panel of FIG. 17.

FIG. 21 shows a driving apparatus for a PDP according to the fourth embodiment of the present invention.

Referring to FIG. 21, the driving apparatus includes a scanning/sustaining driver 112 for driving the scanning/trigger electrode TY, first and second sustaining drivers 128 and 129 for driving the first and second sustaining electrodes SWZ1 and SWZ2, respectively, and a data driver 120 for driving a data electrode 120.

The scanning/sustaining driver 112 sequentially applies a negative scanning pulse to the scanning/trigger electrodes TY in the address interval. Further, the scanning/trigger driver 112 applies a positive DC voltage, a trigger pulse having a voltage level higher than the sustaining pulse, a positive DC voltage having a voltage level lower than that of a pulse signal synchronized with the sustaining pulse to the scanning/trigger electrodes TY.

The first sustaining driver 128 commonly applies a sustaining pulse to the first sustaining electrodes SWZ1 in the sustaining interval. The second sustaining driver 129 commonly applies a sustaining pulse being alternated with respect to the sustaining pulse applied to the first sustaining electrode SWZ1 to the second sustaining electrodes SWZ2. The data driver 120 applies a data pulse synchronized with a scanning pulse to the data electrodes X.

A method of driving the PDP according to the fourth embodiment will be described in conjunction with FIG. 22 and FIGS. 23A to 23E.

Figure 22:
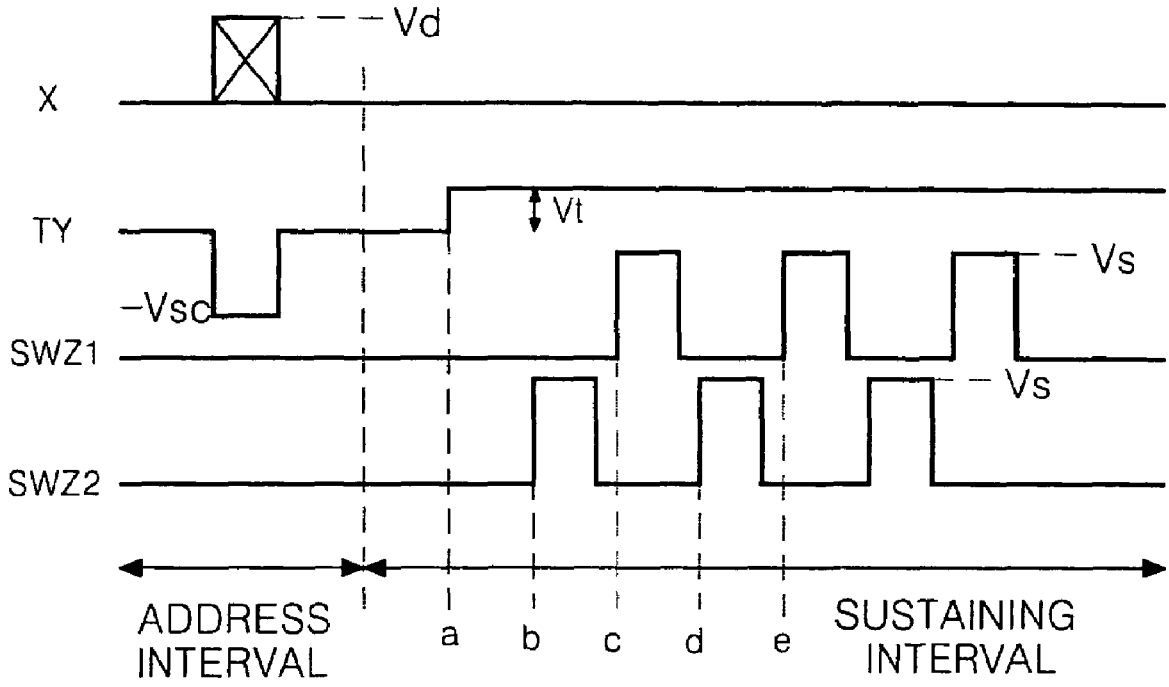
FIG. 22 is a waveform diagram of driving signals according to a first embodiment of the plasma display panel shown in FIG. 17.

Referring to FIG. 22, in the address interval, a data pulse Vd is applied to the data electrode X and a negative scanning pulse—Vsc is applied to the scanning/trigger electrode TY. Then, an address discharge occurs within the discharge cell selected by a voltage difference between the data electrode X and the scanning/trigger electrode TY. By this address discharge, positive wall charges are formed on the scanning/trigger electrode TY while negative wall charges are accumulated in the data electrode X.

Figure 23A:
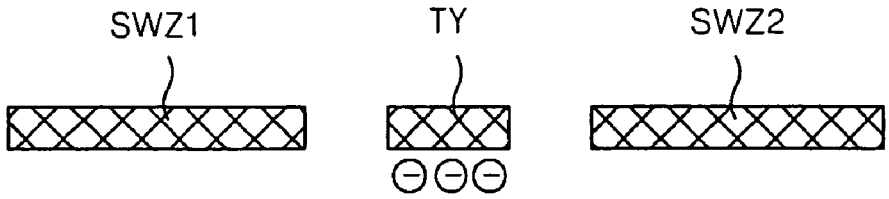
FIG. 23A to FIG. 23E are section views representing a discharge process between the scanning/trigger electrode and the sustaining electrode shown in FIG. 17 step by step.

At an initial time "a" of the sustaining interval, a positive trigger DC voltage Vt begins to be applied to the scanning/trigger electrode TY. The discharge cells generating an address discharge by this positive trigger DC voltage Vt causes a short-path discharge between the scanning/trigger electrode TY and the data electrode X. Electrons created by the short-path discharge concentrate on the scanning/trigger electrode TY. Accordingly, at an initial time "a" of the sustaining interval, negative wall charges are formed on the scanning/trigger electrode TY as shown in FIG. 23A.

At a time "b" when a sustaining pulse Vs is applied to the second sustaining electrode SWZ2, the discharge cells generating a short-path discharge causes a short-path discharge between the scanning/trigger electrode TY and the second sustaining electrode SWZ2. By this short-path discharge, positive wall charges are created on the scanning/trigger electrode TY due to a relative potential difference between it and the second sustaining electrode SWZ2 while negative wall charges are formed on the second sustaining electrode SWZ2. By utilizing the wall charges and the space charges created by the short-path discharge, a long-path discharge occurs between the first and second sustaining electrodes SWZ1 and SWZ2 for each time c, d and e when the sustaining pulse Vs is alternately applied to the first and second sustaining electrodes SWZ1 and SWZ2.

Figure 23B:
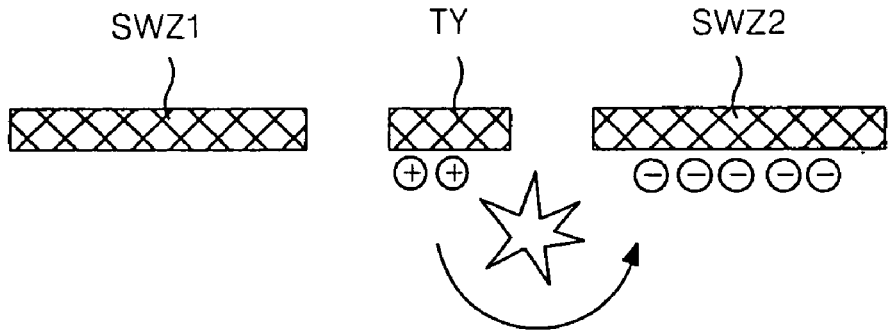
Figure 23C:
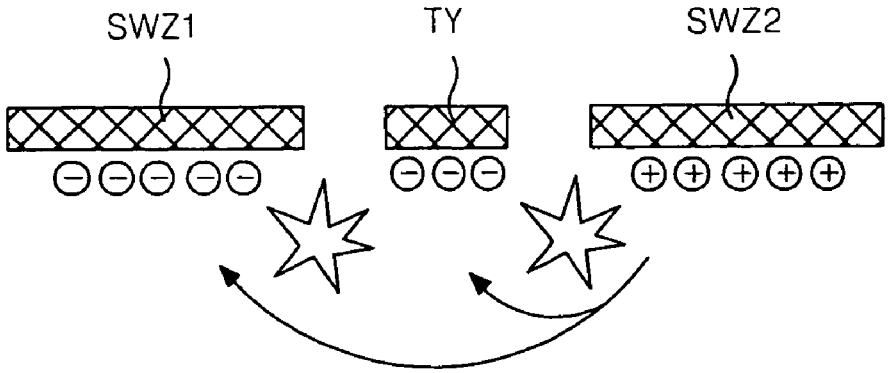

At a time "c", if the sustaining pulse Vs is applied to the first discharge-sustaining electrode SWZ1, then a short-path discharge occurs between the scanning/trigger electrode TY and the second sustaining electrode SWZ2 while a long-path discharge occurs between the first and second sustaining electrodes SWZ1 and SWZ2, as shown in FIG. 23C. By this discharge, negative wall charges are formed on the first sustaining electrode SWZ1 while wall charges having a contrary polarity with respect to the previous state (FIG. 23B) are formed on the scanning/trigger electrode TY and the second sustaining electrode SWZ2.

Figure 23D:
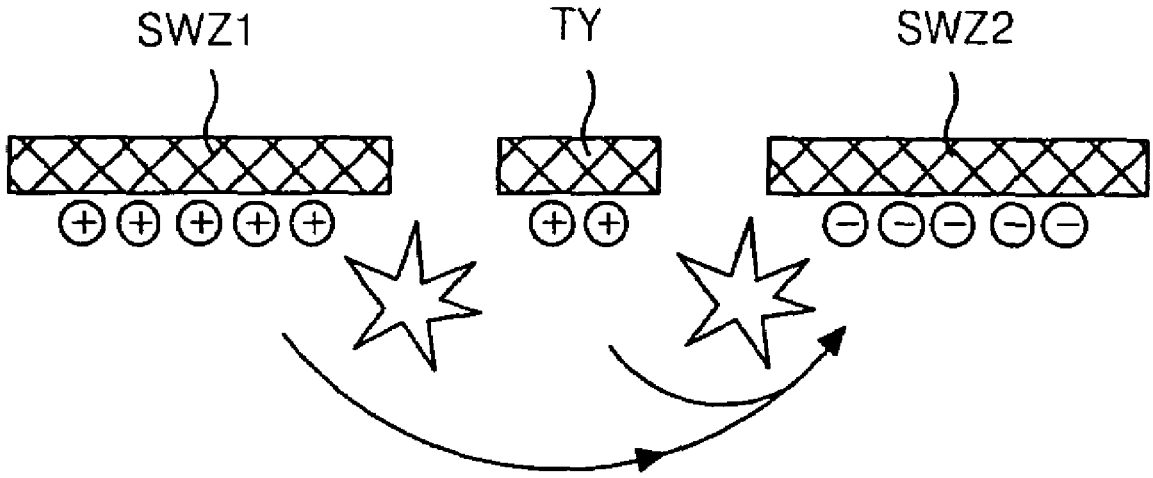

At a time "d", if the sustaining pulse is again applied to the second sustaining electrode SWZ2, then a short-path discharge occurs between the scanning/trigger electrode TY and the second sustaining electrode SWZ2 while a long-path discharge occurs between the first and second sustaining electrodes SWZ1 and SWZ2, as shown in FIG. 23D. By this discharge, negative wall charges are formed on the second sustaining electrode SWZ1 while wall charges having the contrary polarity with respect to the previous state (FIG. 23C) are formed on the scanning/trigger electrode TY and the first sustaining electrode SWZ1.

Figure 23E:
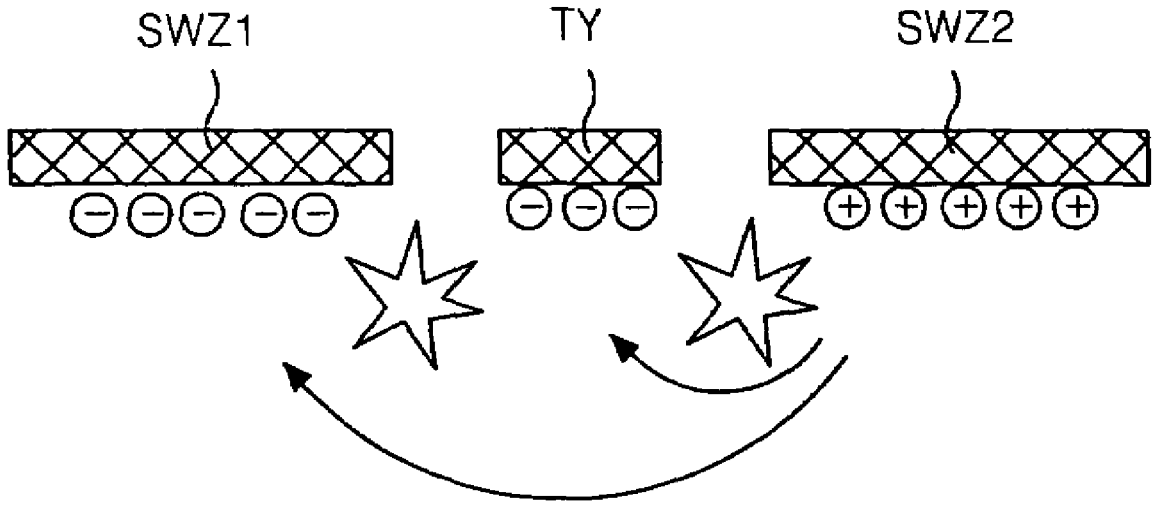

At a time "e", if the sustaining pulse is again applied to the first sustaining electrode SWZ1, then a short-path discharge occurs between the scanning/trigger electrode TY and the second sustaining electrode SWZ2 while a long-path discharge occurs between the first and second sustaining electrodes SWZ1 and SWZ2, as shown in FIG. 23E. By this discharge, negative wall charges are formed on the first sustaining electrode SWZ1 while wall charges having a contrary polarity with respect to the previous state (FIG. 23D) are formed on the scanning/trigger electrode TY and the second sustaining electrode SWZ2.

Figure 24:
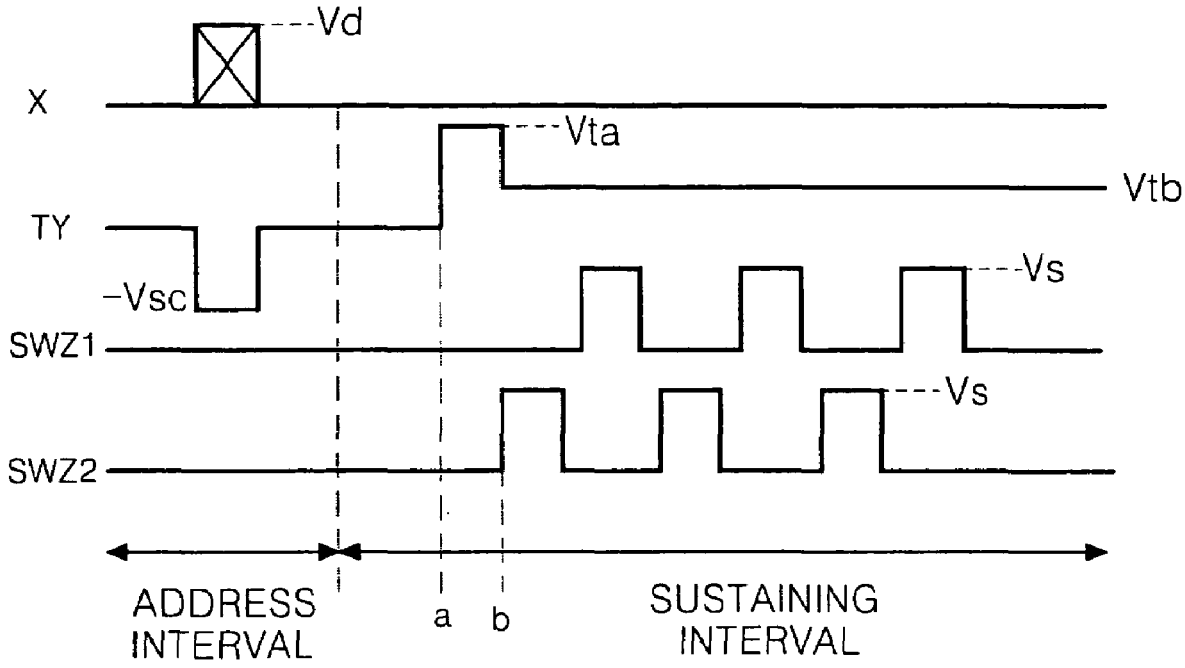
FIG. 24 is a waveform diagram of driving signals according to a second embodiment of the plasma display panel shown in FIG. 17.
Figure 25:
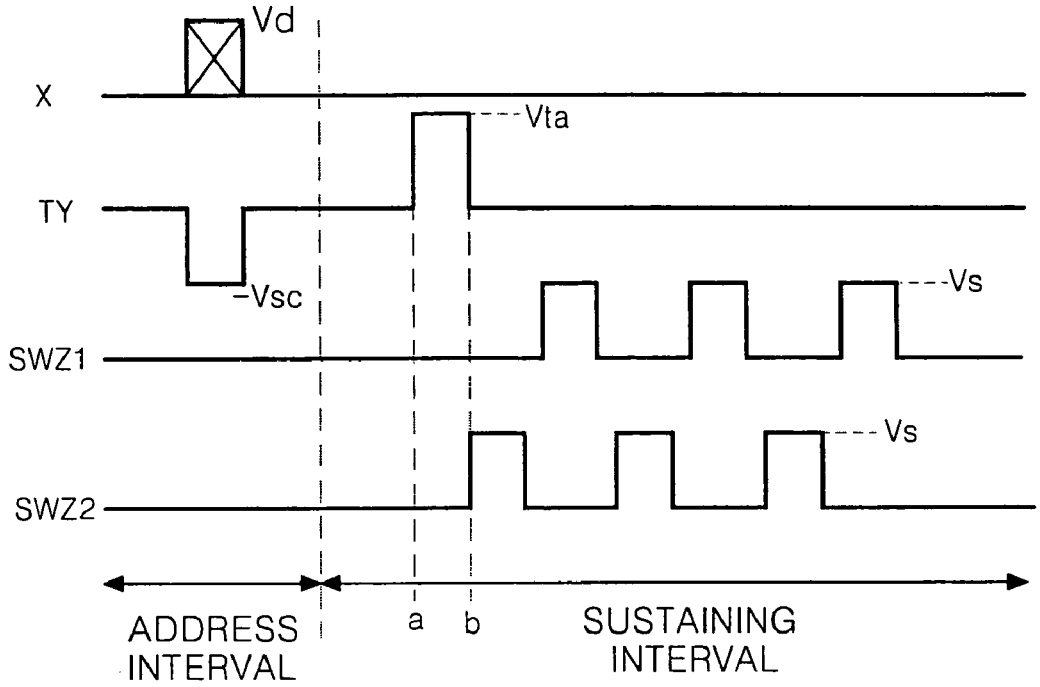
FIG. 25 is a waveform diagram of driving signals according to a third embodiment of the plasma display panel shown in FIG. 17.
Figure 26:
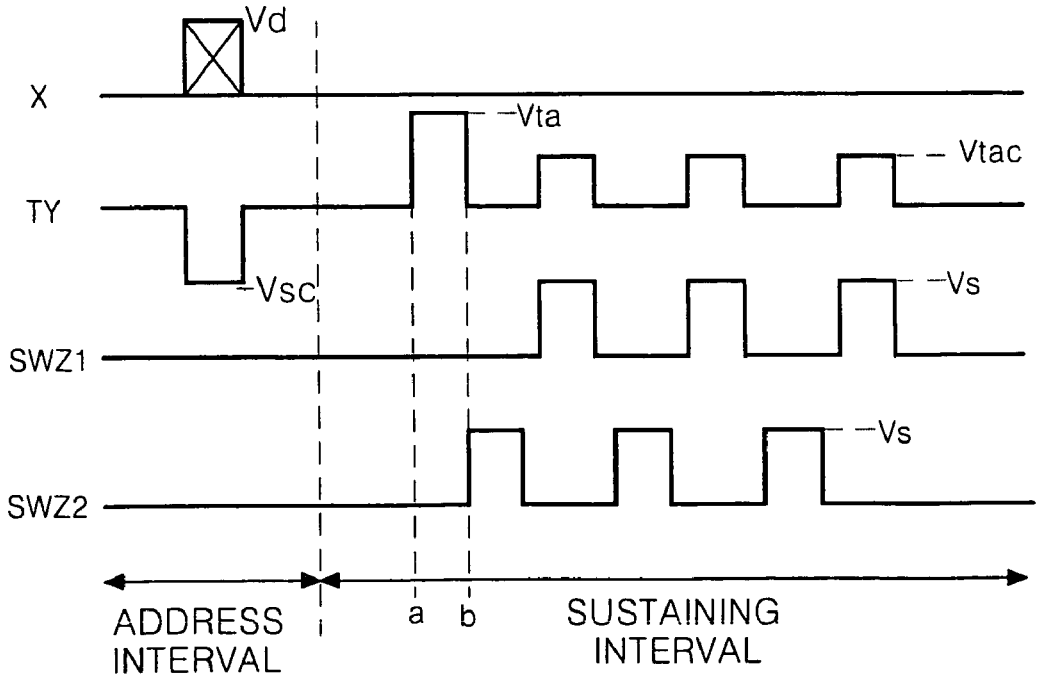
FIG. 26 is a waveform diagram of driving signals according to a fourth embodiment of the plasma display panel shown in FIG. 17.

FIG. 24 to FIG. 26 shows other examples of driving waveforms in the PDP according to the fourth embodiment of the present invention. In FIGS. 24 to 26, the reset interval has been omitted.

Referring to FIG. 24, at a time "a", a trigger pulse Vta having a voltage level higher than the sustaining pulse Vs is applied to the scanning/trigger electrode TY. Then, a short-path discharge occurs between the scanning/trigger electrode TY and the data electrode X. At this time, wall charges are formed on the scanning/trigger electrode TY as shown in FIG. 23A.

At a time "b", a positive DC voltage Vtb having a voltage level lower than the sustaining pulse Vs is applied to the scanning/trigger electrode TY. By this positive DC voltage Vtb, a potential difference capable of causing a discharge is created between the scanning/trigger electrode TY and the second sustaining electrode SWZ2 to generate a short-path discharge between the scanning/trigger electrode TY and the second sustaining electrode SWZ2. By this short-path discharge, wall charges are formed on the scanning/trigger electrode TY and the second sustaining electrode SWZ2 as shown in FIG. 23B.

An application time of the first sustaining voltage pulse Vs is synchronized with the positive DC voltage Vtb applied to the scanning/trigger electrode TY as shown in FIG. 24 such that a priming effect caused by the short-path discharge can be utilized as much as possible. Alternately, an application time of the first sustaining pulse Vs may be delayed by a desired time from an application time of the positive DC voltage Vtb applied to the scanning/trigger electrode TY.

If a sustaining pulse Vs is alternately applied to the first and second sustaining electrodes SWZ1 and SWZ2 after the first sustaining pulse was applied to the second sustaining electrode SWZ2, then a long-path discharge is continuously made as shown in FIG. 23C to FIG. 23E. When such a long-path discharge is being made, a positive DC voltage Vtb is applied to the scanning/trigger electrode TY. If a trigger pulse Vta having a higher voltage than the sustaining pulse Vs and a positive DC voltage Vtb are applied to the scanning/trigger electrode TY before a sustaining pulse is applied, then it becomes possible to increase a quantity of wall charges formed on the scanning/trigger electrode TY.

Referring to FIG. 25, at a time period "a-b" of the sustaining interval, only a trigger pulse Vta having a voltage level higher than the sustaining pulse Vs is applied to the scanning/trigger electrode TY. Then, a short-path discharge occurs between the scanning/trigger electrode TY and the data electrode X. After a time "b" of the sustaining interval, no voltage is applied to the scanning/trigger electrode TY. In this case, since the scanning/trigger electrode TY has a relative potential difference with respect to the sustaining electrodes SWZ1 and SWZ2 supplied with the sustaining pulse Vs, wall charges are formed as shown in FIG. 23B to FIG. 23E by the short-path discharge and the long-path discharge.

Referring to FIG. 26, a trigger pulse Vta having a voltage level higher than the sustaining pulse Vs is applied to the scanning/trigger electrode TY while a voltage pulse Vtac having a voltage level lower than the sustaining pulse Vs is applied to the scanning/trigger electrode TY. A pulse applied to the scanning/trigger electrode TY following the trigger pulse Vta is synchronized with the sustaining pulse Vs applied to the first sustaining electrode SWZ1.

If the trigger pulse Vta is applied to the scanning/trigger electrode TY, then a short-path discharge is generated to form wall charges on the trigger electrode T as shown in FIG. 23A. When the sustaining pulse Vs is alternately applied to the sustaining electrodes SWZ1 and SWZ2, the short-path discharge and the long-path discharge occur. When the short-path discharge and the long-path discharge is being made, wall charges are formed on each of the electrodes TY, SWZ1 and SWZ2 as shown in FIG. 23B to FIG. 23E. The pulse Vtac applied to the scanning/trigger electrode TY following the trigger pulse enlarges a relative potential difference of the sustaining electrodes SWZ1 to SWZ2 to the scanning/trigger electrode TY to increase a quantity of wall charges.

FIG. 27 to FIG. 32 show a five-electrode PDP according to other embodiments of the present invention and a method and apparatus for driving said five-electrode PDP.

Figure 27:
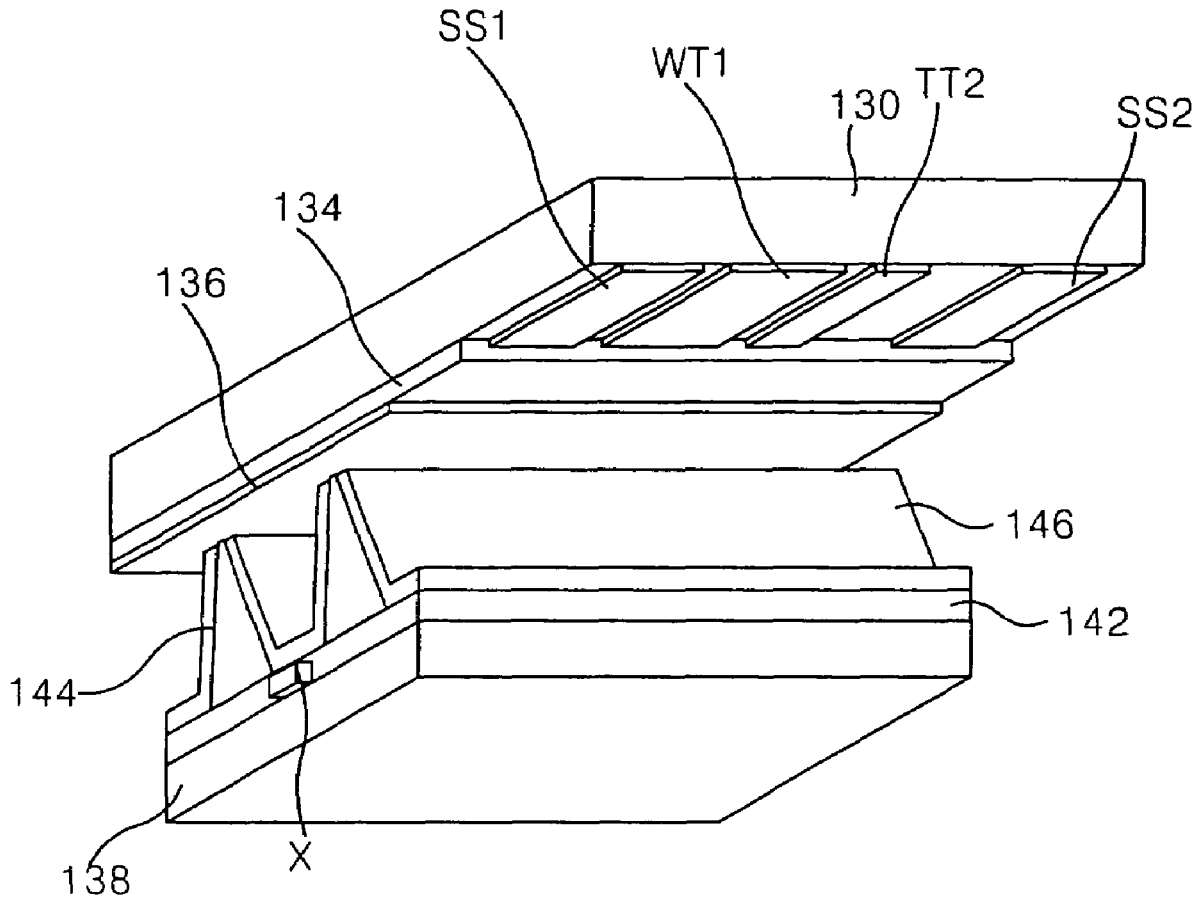
FIG. 27 is a perspective view showing a structure of a discharge cell of a plasma display panel according to a fifth embodiment of the present invention.
Figure 28:
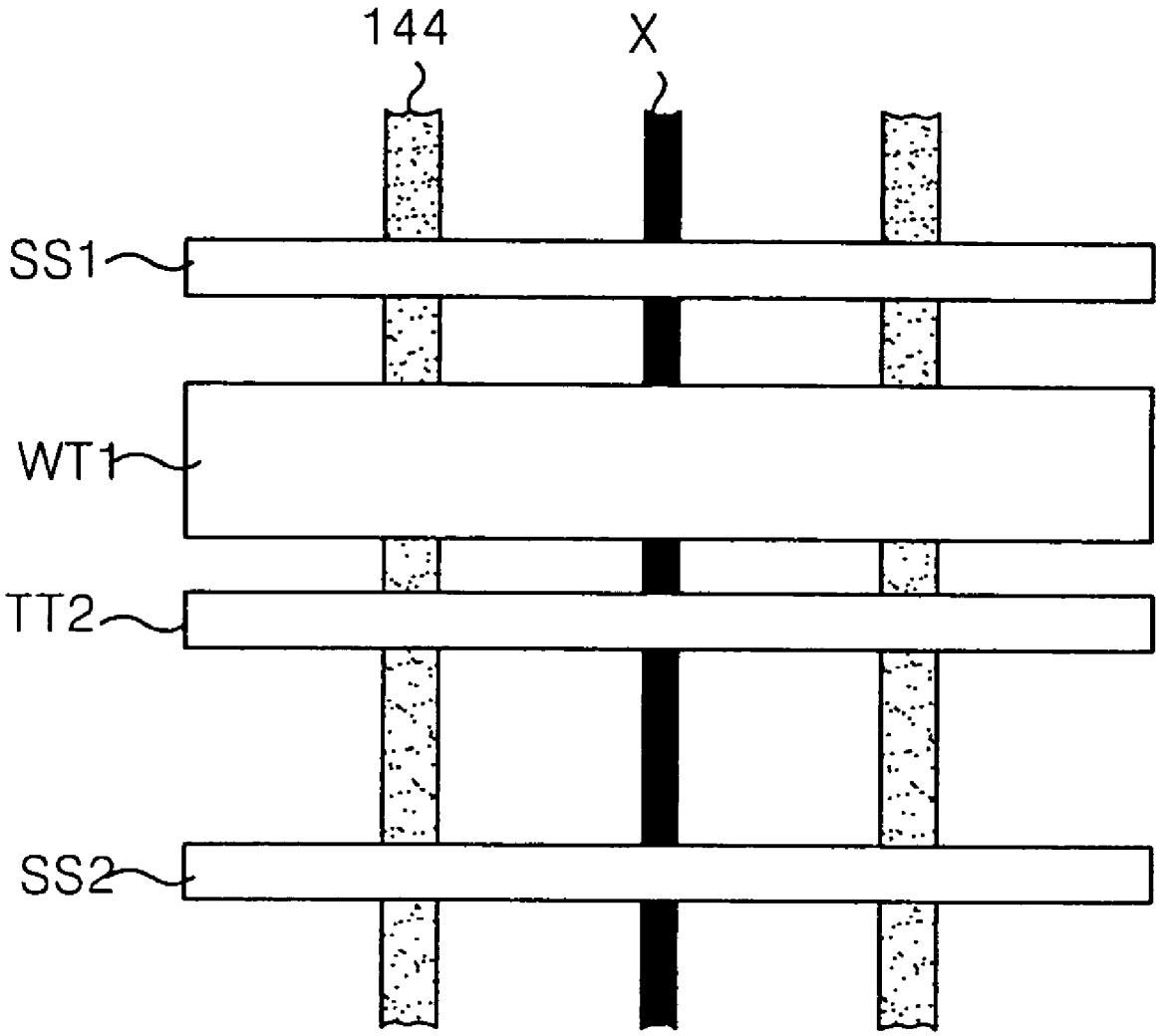
FIG. 28 is a plan view of the plasma display panel of FIG. 27 viewed from the upper position.

Referring to FIG. 27 and FIG. 28, the five-electrode PDP according to the fifth embodiment includes a large width of first trigger electrode WT1, a second trigger electrode TT2 having a smaller width than the first trigger electrode WT1, and first and second sustaining electrodes SS1 and SS2 arranged at each edge of a discharge cell with having the first and second trigger electrodes WT1 and TT2 therebetween.

The trigger electrodes WT1 and TT2 and the sustaining electrodes SS1 and SS2 have a large width of transparent electrodes and a small width of metal bus electrodes and is formed on an upper substrate 130 in parallel to each other. A data electrode X crossing perpendicularly to the trigger electrodes WT1 and TT2 and the sustaining electrodes SS1 and SS2 are provided on a lower substrate 130.

The first trigger electrode WT1 has a larger width than the second trigger electrode TT2 and the sustaining electrodes SS1 and SS2. The first trigger electrode WT1 is supplied with a scanning pulse to cause an address discharge by a potential difference from a data pulse applied to the data electrode X. Since the first trigger electrode WT1 has a wide electrode width, a quantity of wall charges formed on the first trigger electrode WT1 is increased. Also, the first trigger electrode WT1 causes a short-path discharge at an initial time of the sustaining interval along with the second trigger electrode TT2 by the wall charges created by the address discharge and a trigger voltage applied from the exterior thereof. A distance between the first trigger electrode WT1 and the second trigger electrode TT2 is narrowly set such that a stable short-path discharge can be generated at a low voltage. On the other hand, a distance between the second sustaining electrode SS2 and the second trigger electrode TT2 is set to be larger than a distance between the first trigger electrode WT1 and the second trigger electrode TT2.

Since the sustaining electrodes SS1 and SS2 are positioned at each edge of the discharge cell with having the trigger electrodes WT1 and TT2 therebetween, a distance between them is enlarged. The first and second sustaining electrodes SS1 and SS2 causes a long-path discharge by utilizing a priming effect caused by the short-path discharge occurring between the trigger electrodes WT1 and TT2. A distance between the sustaining electrodes SS1 and SS2 has a maximum discharge distance because they are positioned at each of the discharge cell.

An upper dielectric layer 134 and a protective film 136 are disposed on the upper substrate 130 in such a manner to cover the trigger electrodes WT1 and TT2 and the sustaining electrodes SS1 and SS2. Wall charges created upon plasma discharge are accumulated in the upper dielectric layer 134. The protective film 136 prevents a damage of the upper dielectric layer 134 caused by a sputtering during the plasma discharge and improves the emission efficiency of secondary electrons. This protective film 136 is usually made from magnesium oxide (MgO).

A lower dielectric layer 142 and barrier ribs 144 are formed on the lower substrate 138. The surfaces of the lower dielectric layer 142 and the barrier ribs 144 are coated with a fluorescent material layer 146. The barrier ribs 144 separates the adjacent discharge spaces in the horizontal direction to prevent optical and electrical crosstalk between the adjacent discharge spaces. The fluorescent material layer 146 is excited by an ultraviolet ray generated during the plasma discharge to generate any one of red, green and blue visible light rays. An inactive mixture gas of He+Xe or Ne+Xe is injected into a discharge space defined among the upper and lower substrate 130 and 138 and the barrier ribs 144.

Figure 29:
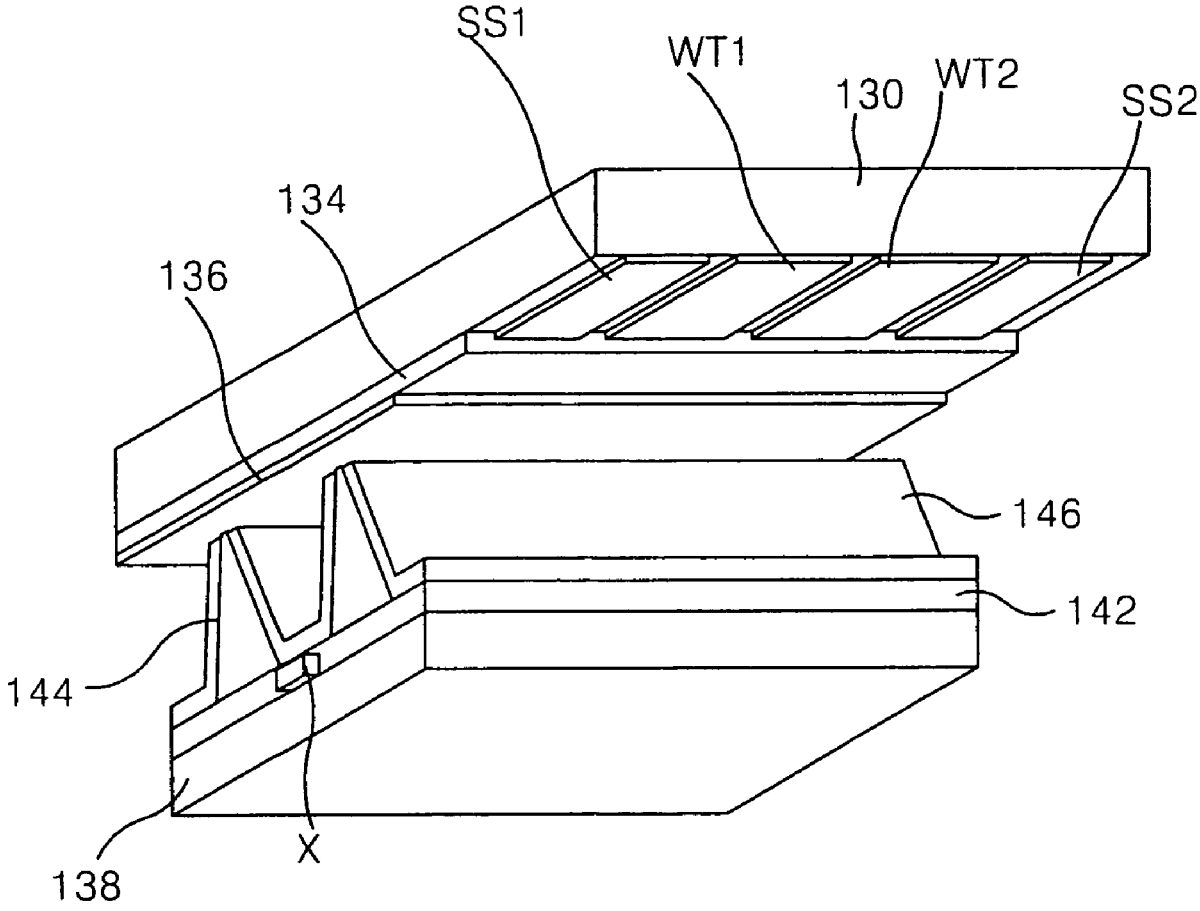
FIG. 29 is a perspective view showing a structure of a discharge cell of a plasma display panel according to a sixth embodiment of the present invention.
Figure 30:
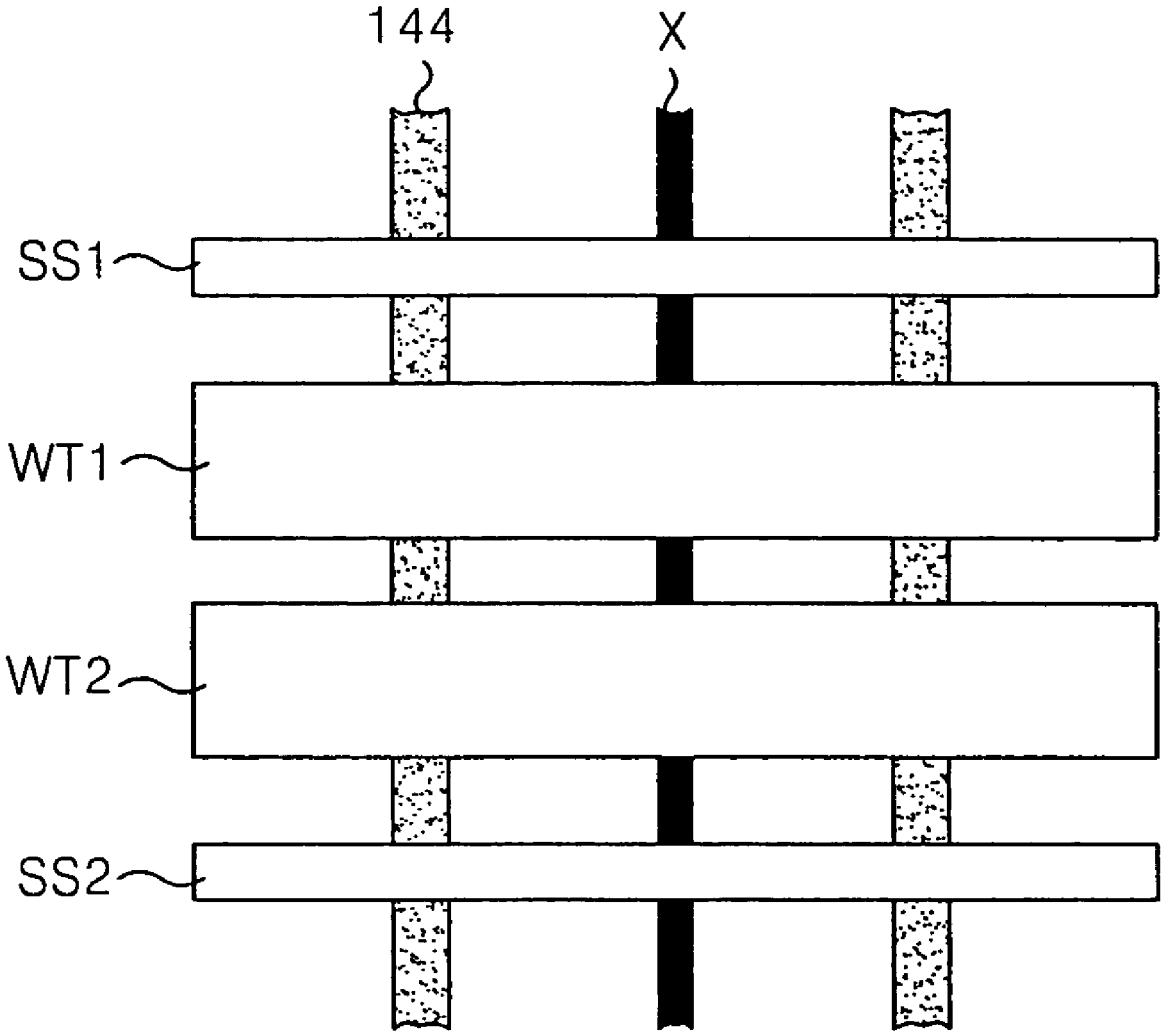
FIG. 30 is a plan view of the plasma display panel of FIG. 29 viewed from the upper position.

Referring to FIG. 29 and FIG. 30, a five-electrode PDP according to a sixth embodiment of the present invention includes first and second trigger electrodes WT1 and WT2 having a large width, and first and second sustaining electrodes SS1 and SS2 arranged at each edge of a discharge cell with having the first and second trigger electrodes WT1 and WT2 therebetween.

When being compared with the five-electrode PDP shown in FIG. 27 and FIG. 28, the five-electrode PDP according to the sixth embodiment has elements being substantially identical to the five-electrode PDP shown in FIG. 27 and FIG. 28 except that widths of all the first and second trigger electrodes WT1 and WT2 are set to be larger than those of the sustaining electrodes SS1 and SS2.

Since widths of the first and second trigger electrodes WT1 and WT2 are enlarged, a quantity of wall charges and space charges formed during the short-path discharge is increased. Thus, a voltage required for a long-path discharge between the first and second sustaining electrodes SS1 and SS2 is lowered to that extent.

Figure 31:
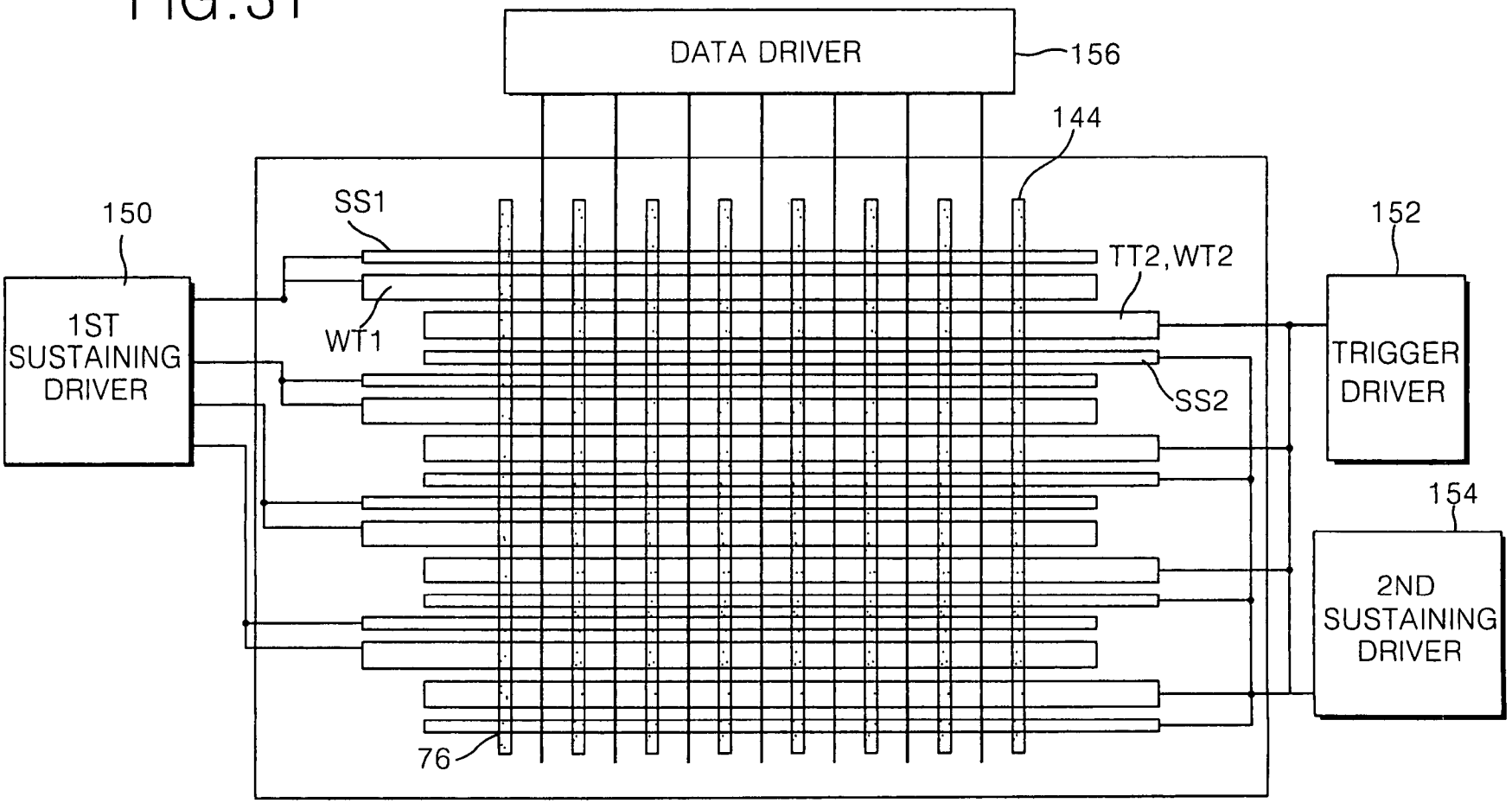
FIG. 31 is a block circuit diagram showing a configuration of a driving apparatus for the plasma display panel of FIGS. 27 and 29.
Figure 32:
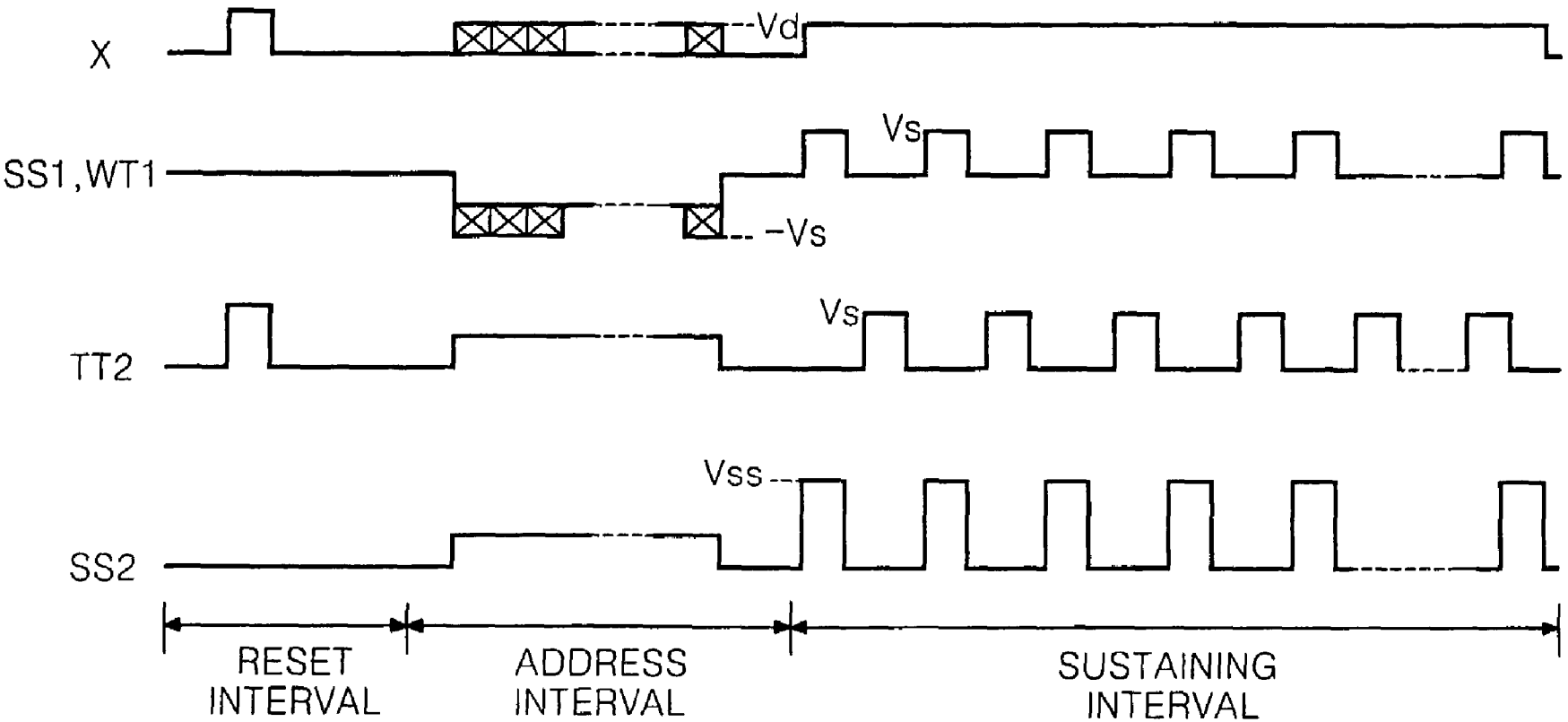
FIG. 32 is a waveform diagram of driving signals for the plasma display panel shown in FIGS. 27 and 29.

FIG. 31 and FIG. 32 shows a driving apparatus for a PDP according to the sixth embodiment of the present invention and an output waveform thereof, respectively.

Referring to FIG. 31, the driving apparatus includes a first sustaining driver 170 for driving the first sustaining electrode SS1 and the first trigger electrode WT1, a trigger driver for driving the second trigger electrode TT2 or WT2, a second sustaining driver 154 for driving the second sustaining electrodes SS2, and a data driver 156 for driving a data electrode X.

The first sustaining driver 150 sequentially applies a negative scanning pulse to the first sustaining electrodes SS1 and the first trigger electrodes WT1 in the address interval. Further, the first sustaining driver 150 applies a sustaining pulse to the first sustaining electrodes SS1 and the first trigger electrodes WT1 in the sustaining interval.

The trigger driver 152 applies a reset pulse to the second trigger electrode TT2 or WT2 in the reset interval and applies a positive DC voltage to the second trigger electrode TT2 or WT2 in the address interval. Further, the second trigger driver 152 applies a sustaining pulse to the second trigger electrode TT2 and WT2 in the sustaining interval.

The second sustaining driver 154 applies a positive DC voltage to the second sustaining electrode SS2 in the address interval and thereafter applies a sustaining pulse to the second sustaining electrode SS2 in the sustaining interval. The sustaining pulse applied to the second sustaining electrode SS2 is set to have a voltage level higher than a sustaining pulse applied to the first and second trigger electrodes WT1 and TT2 or WT2 and the first sustaining electrode SS1.

The data driver 156 applies a data pulse synchronized with the scanning pulse to the data electrodes X.

Referring to FIG. 32, in the reset interval, a high voltage level of positive reset pulse Vrst is applied to the second trigger electrode TT2 or WT2. Then, the discharge cells at the entire field are reset-discharged to be initialized while creating a uniform amount of wall charge. At this time, the data electrode X is supplied with a positive pulse signal having a low voltage level to prevent an erroneous discharge from being generated between the second trigger electrode TT2 or WT2 and the data electrode X.

In the address interval, a scanning pulse—Vsc is sequentially applied to the first trigger electrodes WT1 and the first sustaining electrode SS1. The data electrodes X for one horizontal line are simultaneously supplied with a data pulse Vd synchronized with the scanning pulse—Vsc. At this time, the discharge cell supplied with the data pulse Vd causes an address discharge by a voltage difference between the electrode group including the first trigger electrode WT1 and the first sustaining electrode SS1 and an internal wall voltage. By this address discharge, a sufficient amount of wall charges are formed at a large area on the electrode group including the first trigger electrode WT1 and the first sustaining electrode SS1.

In the sustaining interval, a sustaining pulse Vs or Vss is simultaneously applied to the electrode group including the first trigger electrode WT1 and the first sustaining electrode SS1. Also, the sustaining pulse Vs is applied to the second trigger electrode TT2 or WT2 in such a manner to be alternated with the electrodes WT1, SS1 and SS2. Then, at an initial time of the sustaining interval, a short-path discharge occurs between the first and second trigger electrodes WT1 and WT2 or TT2 by a wall voltage within the discharge cell created by the address discharge and a voltage of the first sustaining pulse applied to the first trigger electrode WT1. Since a sufficient amount of wall charges are formed on the first trigger electrode WT1 and the first sustaining electrode SS1 in the address interval, a voltage level of the sustaining pulse applied to the first trigger electrode WT1 and the first sustaining electrode SS1 can be lowered. A lot of charged particles and wall charges are created within the discharge cell by the short-path discharge between the first and second trigger electrodes WT1 and WT2 or TT2. By utilizing a priming effect caused by such space charges and wall charges, a long-path discharge occurs whenever a sustaining pulse is alternately applied to the first and second sustaining electrodes SS1 and SS2.

As described above, according to the present invention, a sustaining electrode group consists of at least three sustaining electrodes and a width of the electrode for causing an address discharge in the sustaining electrode group is largely set. Accordingly, a sufficient amount of charged particles are created by the address discharge to lower a voltage required for the sustaining discharge, so that power consumption can be reduced and the efficiency can be improved. Furthermore, a sufficient amount of charged particles are created by the address discharge to provide a stable sustaining discharge, so that a miss-writing can be prevented.

In addition, according to the present invention, when only wide metal bus electrodes are included, a light-shielding layer is provided between the substrate and the metal bus electrodes, thereby minimizing a contrast deterioration caused by an external light reflection. Also, the trigger electrode for causing a short-path discharge and the sustaining electrode for causing a long-path discharge are driven with a single of driving circuitry, thereby simplifying a configuration of the driving circuitry and reducing a manufacturing cost.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. For instance, the skilled person in the art will be able to expect that a width of the scanning electrode in the third-electrode PDP may be enlarged on the basis of the technical idea of the present invention in which a width of the electrode for causing an address discharge is enlarged. Accordingly, the scope of the invention shall be determined only by the appended claims and their equivalents.

What is claimed is:

1. A plasma display panel, comprising:

a first substrate and a second substrate opposed to each other and having a plurality of discharge cells formed therebetween;

a first electrode group formed on the first substrate that includes a first sustaining electrode having a first width and a second sustaining electrode;

a second electrode group including at least one electrode having a second width and formed on the first substrate, wherein the first sustaining electrode of the first electrode group is positioned between the second electrode group and the second sustaining electrode, wherein the at least one electrode of the second electrode group comprises a scanning electrode, and wherein one of the discharge cells includes the first electrode group and the second electrode group;

a dielectric layer formed on the first electrode group and the second electrode group; and a protective layer formed on the dielectric layer, wherein the first sustaining electrode of the first electrode group consists of only a first metal bus electrode without a transparent electrode between the first metal bus electrode and the first substrate and the at least one electrode of the second electrode group consists of only a second metal bus electrode.

2. The plasma display panel as claimed in claim 1, wherein the second width is greater than the first width.

3. The plasma display panel as claimed in claim 1, further comprising:

a light-shielding layer provided between the first substrate and the first metal bus electrode.

4. The plasma display panel as claimed in claim 1, wherein a distance between the first sustaining electrode and the second sustaining electrode is within a range of 30 μm to 80 μm.

5. The plasma display panel as claimed in claim 1, wherein a distance between the first electrode group and the second electrode group is greater than a distance between the first sustaining electrode and the second sustaining electrode.

6. The plasma display panel as claimed in claim 1, wherein the first sustaining electrode and the second sustaining electrode are separated from a same line.

7. The plasma display panel as claimed in claim 1, wherein the first sustaining electrode is driven with a different driver than the second sustaining electrode.

8. The plasma display panel as claimed in claim 1, further comprising:

a light-shielding layer provided between the first substrate and the second metal bus electrode.

9. The plasma display panel as claimed in claim 1, wherein a width of the first metal bus electrode of the first electrode group is within a range of 50 μm to 120 μm.

10. The plasma display panel as claimed in claim 1, wherein a width of the second metal bus electrode of the second electrode group is within a range of 50 μm to 120 μm.

11. The plasma display panel as claimed in claim 1, wherein a thickness of the dielectric layer is greater than 25 μm.

12. The plasma display panel as claimed in claim 1, further comprising:

a barrier rib formed on the second substrate to separate two discharge cells, the barrier rib comprising a lattice-shaped barrier rib.

13. The plasma display panel as claimed in claim 1, further comprising:

an inactive mixture gas of He+Xe or Ne+Xe injected within the plasma display panel.

14. The plasma display panel as claimed in claim 1, wherein the first sustaining electrode of the first electrode group consists of only one layer and the at least one electrode of the second electrode group consists of only one layer.

15. The plasma display panel as claimed in claim 1, wherein the first sustaining electrode of the first electrode group consists of the first metal bus electrode without a transparent electrode.

16. A plasma display panel, comprising:

a first substrate and a second substrate opposed to each other and having a plurality of discharge cells formed therebetween;

a first electrode group that includes a first sustaining electrode formed on the first substrate and a second sustaining electrode formed on the first substrate, the first sustaining electrode including a first metal bus electrode having a first width and provided without a transparent electrode between the first metal bus electrode and the first substrate;

a second electrode group including a second metal bus electrode having a second width and formed on the first substrate, wherein the first sustaining electrode of the first electrode group is positioned between the second electrode group and the second sustaining electrode, wherein the second metal bus electrode comprises a scanning electrode, and wherein one of the discharge cells includes the first sustaining electrode and the second sustaining electrode;

a dielectric layer formed on the first electrode group and the second electrode group; and a protective layer formed on the dielectric layer.

17. The plasma display panel as claimed in claim 16, wherein the second width is greater than the first width.

18. The plasma display panel as claimed in claim 16, further comprising:

a light-shielding layer provided between the first substrate and the first metal bus electrode.

19. The plasma display panel as claimed in claim 16, wherein a distance between the first sustaining electrode and the second sustaining electrode is 30 μm to 80 μm.

20. The plasma display panel as claimed in claim 16, wherein a distance between the first electrode group and the second electrode group is greater than a distance between the first sustaining electrode and the second sustaining electrode.

21. The plasma display panel as claimed in claim 16, wherein the first width is within a range of 50 μm to 120 μm.

22. The plasma display panel as claimed in claim 16, wherein the second width is within a range of 50 μm to 120 μm.

23. The plasma display panel as claimed in claim 16, wherein a thickness of the dielectric layer is greater than 25 μm.

24. The plasma display panel as claimed in claim 16, wherein the first sustaining electrode of the first electrode group consists of only one layer and the second metal bus electrode of the second electrode group consist of only one layer.

25. A plasma display panel, comprising:

a first substrate, a second substrate and a plurality of discharge cells formed between the first substrate and the second substrate;

a first electrode group including a first sustaining electrode having a first width and formed on the first substrate and a second sustaining electrode formed on the first substrate, the first sustaining electrode consisting of only a first metal bus electrode;

a second electrode group including at least one electrode having a second width and formed on the first substrate, the at least one electrode consisting of only a second metal bus electrode, wherein the first sustaining electrode of the first electrode group is positioned between the second electrode group and the second sustaining electrode, wherein the at least one electrode of the second electrode group comprises a scanning electrode, and wherein the first sustaining electrode, the second sustaining electrode and the at least one electrode of the second electrode group are associated with one of the discharge cells;

a first light-shielding layer provided between the first substrate and the first metal bus electrode without a transparent electrode provided between the first substrate and the first metal bus electrode; and a second light-shielding layer provided between the first substrate and the second metal bus electrode.

26. The plasma display panel as claimed in claim 25, wherein a distance between the first sustaining electrode and the second sustaining electrode is 30 μm to 80 μm.

27. The plasma display panel as claimed in claim 25, wherein a distance between the first electrode group and the second electrode group is greater than a distance between the first sustaining electrode and the second sustaining electrode.

28. The plasma display panel as claimed in claim 25, wherein the first width is 50 μm to 120 μm.

29. The plasma display panel as claimed in claim 25, wherein the second width is 50 μm to 120 μm.

30. The plasma display panel as claimed in claim 25, wherein the first sustaining electrode in the first electrode group consists of only one layer and the at least one electrode in the second electrode group consist of only one layer.

31. The plasma display panel as claimed in claim 25, wherein the first light-shielding layer is immediately adjacent the first substrate and the first metal bus electrode is immediately adjacent the first light-shielding layer.

32. The plasma display panel as claimed in claim 3, wherein the light-shielding layer is immediately adjacent the first substrate and the first metal bus electrode is immediately adjacent the light-shielding layer.

33. The plasma display panel as claimed in claim 1, wherein the first electrode group includes the first sustaining electrode of the first electrode group and any electrode that contacts the first sustaining electrode of the first electrode group.

34. The plasma display panel as claimed in claim 18, wherein the light-shielding layer is immediately adjacent the first substrate and the first metal bus electrode is immediately adjacent the light-shielding layer.

35. The plasma display panel as claimed in claim 16, wherein the first electrode group includes the first metal bus electrode and any electrode that contacts the first metal bus electrode.

36. The plasma display panel as claimed in claim 1, wherein the first sustaining electrode and the second sustaining electrode are separated from a same line such that the first sustaining electrode and the second sustaining electrode are commonly coupled.

37. The plasma display panel as claimed in claim 1, wherein the first sustaining electrode is driven with a same driver as the second sustaining electrode.

38. The plasma display panel as claimed in claim 16, wherein the first sustaining electrode and the second sustaining electrode are separated from a same line such that the first sustaining electrode and the second sustaining electrode are commonly coupled.

39. The plasma display panel as claimed in claim 16, wherein the first sustaining electrode is driven with a same driver as the second sustaining electrode.

40. The plasma display panel as claimed in claim 25, wherein the first sustaining electrode and the second sustaining electrode are separated from a same line such that the first sustaining electrode and the second sustaining electrode are commonly coupled.

41. The plasma display panel as claimed in claim 25, wherein the first sustaining electrode is driven with a same driver as the second sustaining electrode.

* * * * *